US011613980B2

(12) United States Patent
Yeung et al.

(10) Patent No.: US 11,613,980 B2
(45) **Date of Patent: *Mar. 28, 2023**

(54) METHODS AND SYSTEMS FOR OPERATING A FLEET OF PUMPS

(71) Applicant: BJ Energy Solutions, LLC, Houston, TX (US)

(72) Inventors: Tony Yeung, Houston, TX (US); Ricardo Rodriguez-Ramon, Houston, TX (US); Diankui Fu, Houston, TX (US); Warren Zemlak, Houston, TX (US); Samir Nath Seth, Houston, TX (US); Joseph Foster, Houston, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/389,536

(22) Filed: Jul. 30, 2021

(65) Prior Publication Data

US 2021/0355802 A1 Nov. 18, 2021

Related U.S. Application Data

(63) Continuation of application No. 17/387,477, filed on Jul. 28, 2021, which is a continuation of application (Continued)

(51) Int. Cl.

| | |
|---|---|
| ***E21B 43/26*** | (2006.01) |
| ***F04B 49/20*** | (2006.01) |
| ***F04B 23/04*** | (2006.01) |

(52) U.S. Cl.

CPC ..... *E21B 43/2607* (2020.05); *F04B 23/04* (2013.01); *F04B 49/20* (2013.01); *F04B 2201/1203* (2013.01)

(58) Field of Classification Search

CPC ..... E21B 43/2607; E21B 43/26; F04B 23/04; F04B 49/20; F04B 2201/1203

See application file for complete search history.

(56) References Cited

U.S. PATENT DOCUMENTS

| | | | |
|---|---|---|---|
| 1,716,049 | A | 6/1929 | Greve |
| 1,726,633 | A | 9/1929 | Smith |
| 2,178,662 | A | 11/1939 | Lars |
| 2,427,638 | A | 9/1947 | Vilter |
| 2,498,229 | A | 2/1950 | Adler |

(Continued)

FOREIGN PATENT DOCUMENTS

| | | |
|---|---|---|
| AU | 9609498 | 7/1999 |
| AU | 737970 | 9/2001 |

(Continued)

OTHER PUBLICATIONS

US 11,555,493 B2, 01/2023, Chang et al. (withdrawn)

(Continued)

*Primary Examiner* — James G Sayre

(74) *Attorney, Agent, or Firm* — Womble Bond Dickinson (US) LLP

(57) ABSTRACT

A system and method for operating a fleet of pumps for a turbine driven fracturing pump system used in hydraulic fracturing is disclosed. In an embodiment, a method of operating a fleet of pumps associated with a hydraulic fracturing system includes receiving a demand Hydraulic Horse Power (HHP) signal. The demand HHP signal may include the Horse Power (HP) required for the hydraulic fracturing system to operate and may include consideration for frictional and other losses. The method further includes operating all available pump units at a percentage of rating below Maximum Continuous Power (MCP) level, based at least in part on the demand HHP signal. Furthermore, the method may include receiving a signal for loss of power from one or more pump units. The method further includes (Continued)

operating one or more units at MCP level and operating one or more units at Maximum Intermittent Power (MIP) level to meet the demand HHP signal.

27 Claims, 7 Drawing Sheets

Related U.S. Application Data

No. 17/118,790, filed on Dec. 11, 2020, which is a continuation of application No. 17/022,972, filed on Sep. 16, 2020, now Pat. No. 10,907,459, which is a continuation of application No. 16/946,082, filed on Jun. 5, 2020, now Pat. No. 10,815,764.

(60) Provisional application No. 62/899,951, filed on Sep. 13, 2019.

(56) References Cited

U.S. PATENT DOCUMENTS 2,535,703 A 12/1950 Smith et al.
2,572,711 A 10/1951 Fischer
2,820,341 A 1/1958 Amann
2,868,004 A 1/1959 Runde
2,940,377 A 6/1960 Darnell et al.
2,947,141 A 8/1960 Russ
2,956,738 A 10/1960 Rosenschold
3,068,796 A 12/1962 Pfluger et al.
3,191,517 A 6/1965 Solzman
3,257,031 A 6/1966 Dietz
3,274,768 A 9/1966 Klein
3,378,074 A 4/1968 Kiel
3,382,671 A 5/1968 Ehni, III
3,401,873 A 9/1968 Privon
3,463,612 A 8/1969 Whitsel
3,496,880 A 2/1970 Wolff
3,550,696 A 12/1970 Kenneday
3,586,459 A 6/1971 Zerlauth
3,632,222 A 1/1972 Cronstedt
3,656,582 A 4/1972 Alcock
3,667,868 A 6/1972 Brunner
3,692,434 A 9/1972 Schnear
3,739,872 A 6/1973 McNair
3,757,581 A 9/1973 Mankin
3,759,063 A 9/1973 Bendall
3,765,173 A 10/1973 Harris
3,771,916 A 11/1973 Flanigan et al.
3,773,438 A 11/1973 Hall et al.
3,786,835 A 1/1974 Finger
3,791,682 A 2/1974 Mitchell
3,796,045 A 3/1974 Foster
3,814,549 A 6/1974 Cronstedt
3,820,922 A 6/1974 Buse et al.
3,847,511 A 11/1974 Cole
3,866,108 A 2/1975 Yannone
3,875,380 A 4/1975 Rankin
3,951,019 A 4/1976 Johnson et al.
3,963,372 A 6/1976 McLain et al.
4,010,613 A 3/1977 McInerney
4,019,477 A 4/1977 Overton
4,031,407 A 6/1977 Reed
4,050,862 A 9/1977 Buse
4,059,045 A 11/1977 McClain
4,086,976 A 5/1978 Holm et al.
4,117,342 A 9/1978 Melley, Jr.
4,173,121 A 11/1979 Yu
4,204,808 A 5/1980 Reese et al.
4,209,079 A 6/1980 Marchal et al.
4,209,979 A 7/1980 Woodhouse et al.
4,222,229 A 9/1980 Uram
4,269,569 A 5/1981 Hoover
4,311,395 A 1/1982 Douthitt et al.
4,330,237 A 5/1982 Battah
4,341,508 A 7/1982 Rambin, Jr.
4,357,027 A 11/1982 Zeitlow
4,383,478 A 5/1983 Jones
4,402,504 A 9/1983 Christian
4,430,047 A 2/1984 Ilg
4,442,665 A 4/1984 Fick
4,457,325 A 7/1984 Green
4,470,771 A 9/1984 Hall et al.
4,483,684 A 11/1984 Black
4,505,650 A 3/1985 Hannett et al.
4,574,880 A 3/1986 Handke
4,584,654 A 4/1986 Crane
4,620,330 A 11/1986 Izzi, Sr.
4,672,813 A 6/1987 David
4,754,607 A 7/1988 Mackay
4,782,244 A 11/1988 Wakimoto
4,796,777 A 1/1989 Keller
4,869,209 A 9/1989 Young
4,913,625 A 4/1990 Gerlowski
4,983,259 A 1/1991 Duncan
4,990,058 A 2/1991 Eslinger
5,032,065 A 7/1991 Yamamuro
5,135,361 A 8/1992 Dion
5,167,493 A 12/1992 Kobari
5,245,970 A 9/1993 Iwaszkiewicz et al.
5,291,842 A 3/1994 Sallstrom et al.
5,326,231 A 7/1994 Pandeya
5,362,219 A 11/1994 Paul et al.
5,511,956 A 4/1996 Hasegawa
5,537,813 A 7/1996 Davis et al.
5,553,514 A 9/1996 Walkowc
5,560,195 A 10/1996 Anderson et al.
5,586,444 A 12/1996 Fung
5,622,245 A 4/1997 Reik
5,626,103 A 5/1997 Haws et al.
5,634,777 A 6/1997 Albertin
5,651,400 A 7/1997 Corts et al.
5,678,460 A 10/1997 Walkowc
5,717,172 A 2/1998 Griffin, Jr. et al.
5,720,598 A * 2/1998 de Chizzelle ..... F04B 51/00 417/53
5,761,084 A 6/1998 Edwards
5,811,676 A 9/1998 Spalding et al.
5,839,888 A 11/1998 Harrison
5,846,062 A 12/1998 Yanagisawa et al.
5,875,744 A 3/1999 Vallejos
5,983,962 A 11/1999 Gerardot
5,992,944 A 11/1999 Hara
6,041,856 A 3/2000 Thrasher et al.
6,050,080 A 4/2000 Horner
6,067,962 A 5/2000 Bartley et al.
6,071,188 A 6/2000 O'Neill et al.
6,074,170 A 6/2000 Bert et al.
6,123,751 A 9/2000 Nelson et al.
6,129,335 A 10/2000 Yokogi
6,145,318 A 11/2000 Kaplan et al.
6,230,481 B1 5/2001 Jahr
6,279,309 B1 8/2001 Lawlor, II et al.
6,321,860 B1 11/2001 Reddoch
6,334,746 B1 1/2002 Nguyen et al.
6,388,317 B1 5/2002 Reese
6,401,472 B2 6/2002 Pollrich
6,530,224 B1 3/2003 Conchier
6,543,395 B2 4/2003 Green
6,655,922 B1 12/2003 Flek
6,669,453 B1 12/2003 Breeden
6,765,304 B2 7/2004 Baten et al.
6,786,051 B2 9/2004 Kristich et al.
6,832,900 B2 12/2004 Leu
6,851,514 B2 2/2005 Han et al.
6,859,740 B2 2/2005 Stephenson et al.
6,901,735 B2 6/2005 Lohn
6,962,057 B2 11/2005 Kurokawa et al.
7,007,966 B2 3/2006 Campion
7,047,747 B2 5/2006 Tanaka
7,065,953 B1 6/2006 Kopko
7,143,016 B1 11/2006 Discenzo et al.
7,222,015 B2 5/2007 Davis et al.
7,281,519 B2 10/2007 Schroeder

(56) References Cited

U.S. PATENT DOCUMENTS

| | | | |
|---|---|---|---|
| 7,388,303 | B2 | 6/2008 | Seiver |
| 7,404,294 | B2 | 7/2008 | Sundin |
| 7,442,239 | B2 | 10/2008 | Armstrong et al. |
| 7,524,173 | B2 | 4/2009 | Cummins |
| 7,545,130 | B2 | 6/2009 | Latham |
| 7,552,903 | B2 | 6/2009 | Dunn et al. |
| 7,563,076 | B2 | 7/2009 | Brunet et al. |
| 7,563,413 | B2 | 7/2009 | Naets et al. |
| 7,574,325 | B2 | 8/2009 | Dykstra |
| 7,594,424 | B2 | 9/2009 | Fazekas |
| 7,614,239 | B2 | 11/2009 | Herzog et al. |
| 7,627,416 | B2 | 12/2009 | Batenburg et al. |
| 7,677,316 | B2 | 3/2010 | Butler et al. |
| 7,721,521 | B2 | 5/2010 | Kunkle et al. |
| 7,730,711 | B2 | 6/2010 | Kunkle et al. |
| 7,779,961 | B2 | 8/2010 | Matte |
| 7,789,452 | B2 | 9/2010 | Dempsey et al. |
| 7,836,949 | B2 | 11/2010 | Dykstra |
| 7,841,394 | B2 | 11/2010 | McNeel et al. |
| 7,845,413 | B2 | 12/2010 | Shampine et al. |
| 7,861,679 | B2 | 1/2011 | Lemke et al. |
| 7,886,702 | B2 | 2/2011 | Jerrell et al. |
| 7,900,724 | B2 | 3/2011 | Promersberger et al. |
| 7,921,914 | B2 | 4/2011 | Bruins et al. |
| 7,938,151 | B2 | 5/2011 | Höckner |
| 7,955,056 | B2 | 6/2011 | Pettersson |
| 7,980,357 | B2 | 7/2011 | Edwards |
| 8,056,635 | B2 | 11/2011 | Shampine et al. |
| 8,083,504 | B2 | 12/2011 | Williams et al. |
| 8,099,942 | B2 | 1/2012 | Alexander |
| 8,186,334 | B2 | 5/2012 | Ooyama |
| 8,196,555 | B2 | 6/2012 | Ikeda et al. |
| 8,202,354 | B2 | 6/2012 | Iijima |
| 8,316,936 | B2 | 11/2012 | Roddy et al. |
| 8,336,631 | B2 | 12/2012 | Shampine et al. |
| 8,414,673 | B2 | 4/2013 | Raje et al. |
| 8,469,826 | B2 | 6/2013 | Brosowske |
| 8,500,215 | B2 | 8/2013 | Gastauer |
| 8,506,267 | B2 | 8/2013 | Gambier et al. |
| 8,575,873 | B2 | 11/2013 | Peterson et al. |
| 8,616,005 | B1 | 12/2013 | Cousino, Sr. et al. |
| 8,621,873 | B2 | 1/2014 | Robertson et al. |
| 8,641,399 | B2 | 2/2014 | Mucibabic |
| 8,656,990 | B2 | 2/2014 | Kajaria et al. |
| 8,672,606 | B2 | 3/2014 | Glynn et al. |
| 8,707,853 | B1 | 4/2014 | Dille et al. |
| 8,714,253 | B2 | 5/2014 | Sherwood et al. |
| 8,757,918 | B2 | 6/2014 | Ramnarain et al. |
| 8,763,583 | B2 | 7/2014 | Hofbauer et al. |
| 8,770,329 | B2 | 7/2014 | Spitler |
| 8,784,081 | B1 | 7/2014 | Blume |
| 8,789,601 | B2 | 7/2014 | Broussard et al. |
| 8,794,307 | B2 | 8/2014 | Coquilleau et al. |
| 8,801,394 | B2 | 8/2014 | Anderson |
| 8,851,186 | B2 | 10/2014 | Shampine et al. |
| 8,851,441 | B2 | 10/2014 | Acuna et al. |
| 8,905,056 | B2 | 12/2014 | Kendrick |
| 8,973,560 | B2 | 3/2015 | Krug |
| 8,997,904 | B2 | 4/2015 | Cryer et al. |
| 9,011,111 | B2 | 4/2015 | Lesko |
| 9,016,383 | B2 | 4/2015 | Shampine et al. |
| 9,032,620 | B2 | 5/2015 | Frassinelli et al. |
| 9,057,247 | B2 | 6/2015 | Kumar et al. |
| 9,097,249 | B2 | 8/2015 | Petersen |
| 9,103,193 | B2 | 8/2015 | Coli et al. |
| 9,121,257 | B2 | 9/2015 | Coli et al. |
| 9,140,110 | B2 | 9/2015 | Coli et al. |
| 9,175,810 | B2 | 11/2015 | Hains |
| 9,187,982 | B2 | 11/2015 | Dehring et al. |
| 9,206,667 | B2 | 12/2015 | Khvoshchev et al. |
| 9,212,643 | B2 | 12/2015 | Deliyski |
| 9,222,346 | B1 | 12/2015 | Walls |
| 9,324,049 | B2 | 4/2016 | Thomeer et al. |
| 9,341,055 | B2 | 5/2016 | Weightman et al. |
| 9,346,662 | B2 | 5/2016 | Van Vliet et al. |
| 9,366,114 | B2 | 6/2016 | Coli et al. |
| 9,376,786 | B2 | 6/2016 | Numasawa |
| 9,394,829 | B2 | 7/2016 | Cabeen et al. |
| 9,395,049 | B2 | 7/2016 | Vicknair et al. |
| 9,401,670 | B2 | 7/2016 | Minato et al. |
| 9,410,410 | B2 | 8/2016 | Broussard et al. |
| 9,410,546 | B2 | 8/2016 | Jaeger et al. |
| 9,429,078 | B1 | 8/2016 | Crowe et al. |
| 9,435,333 | B2 | 9/2016 | McCoy et al. |
| 9,488,169 | B2 | 11/2016 | Cochran et al. |
| 9,493,997 | B2 | 11/2016 | Liu et al. |
| 9,512,783 | B2 | 12/2016 | Veilleux et al. |
| 9,534,473 | B2 | 1/2017 | Morris et al. |
| 9,546,652 | B2 | 1/2017 | Yin |
| 9,550,501 | B2 | 1/2017 | Ledbetter |
| 9,556,721 | B2 | 1/2017 | Jang et al. |
| 9,562,420 | B2 | 2/2017 | Morris et al. |
| 9,570,945 | B2 | 2/2017 | Fischer |
| 9,579,980 | B2 | 2/2017 | Cryer et al. |
| 9,587,649 | B2 | 3/2017 | Oehring |
| 9,593,710 | B2 | 3/2017 | Laimboeck et al. |
| 9,611,728 | B2 | 4/2017 | Oehring |
| 9,617,808 | B2 | 4/2017 | Liu et al. |
| 9,638,101 | B1 | 5/2017 | Crowe et al. |
| 9,638,194 | B2 | 5/2017 | Megman et al. |
| 9,650,871 | B2 | 5/2017 | Oehring et al. |
| 9,656,762 | B2 | 5/2017 | Kamath et al. |
| 9,689,316 | B1 | 6/2017 | Crom |
| 9,695,808 | B2 | 7/2017 | Giessbach et al. |
| 9,739,130 | B2 | 8/2017 | Young |
| 9,764,266 | B1 | 9/2017 | Carter |
| 9,777,748 | B2 | 10/2017 | Lu et al. |
| 9,803,467 | B2 | 10/2017 | Tang et al. |
| 9,803,793 | B2 | 10/2017 | Davi et al. |
| 9,809,308 | B2 | 11/2017 | Aguilar et al. |
| 9,829,002 | B2 | 11/2017 | Crom |
| 9,840,897 | B2 | 12/2017 | Larson |
| 9,840,901 | B2 | 12/2017 | Oering et al. |
| 9,845,730 | B2 | 12/2017 | Betti et al. |
| 9,850,422 | B2 | 12/2017 | Lestz et al. |
| 9,856,131 | B1 | 1/2018 | Moffitt |
| 9,863,279 | B2 | 1/2018 | Laing et al. |
| 9,869,305 | B1 | 1/2018 | Crowe et al. |
| 9,871,406 | B1 | 1/2018 | Churnock et al. |
| 9,879,609 | B1 | 1/2018 | Crowe et al. |
| RE46,725 | E | 2/2018 | Case et al. |
| 9,893,500 | B2 | 2/2018 | Oehring et al. |
| 9,893,660 | B2 | 2/2018 | Peterson et al. |
| 9,897,003 | B2 | 2/2018 | Motakef et al. |
| 9,920,615 | B2 | 3/2018 | Zhang et al. |
| 9,945,365 | B2 | 4/2018 | Hernandez et al. |
| 9,964,052 | B2 | 5/2018 | Millican et al. |
| 9,970,278 | B2 | 5/2018 | Broussard et al. |
| 9,981,840 | B2 | 5/2018 | Shock |
| 9,995,102 | B2 | 6/2018 | Dillie et al. |
| 9,995,218 | B2 | 6/2018 | Oehring et al. |
| 10,008,880 | B2 | 6/2018 | Vicknair et al. |
| 10,008,912 | B2 | 6/2018 | Davey et al. |
| 10,018,096 | B2 | 7/2018 | Wallimann et al. |
| 10,020,711 | B2 | 7/2018 | Oehring et al. |
| 10,024,123 | B2 | 7/2018 | Steffenhagen et al. |
| 10,029,289 | B2 | 7/2018 | Wendorski et al. |
| 10,030,579 | B2 | 7/2018 | Austin et al. |
| 10,036,238 | B2 | 7/2018 | Oehring |
| 10,040,541 | B2 | 8/2018 | Wilson et al. |
| 10,060,293 | B2 | 8/2018 | Del Bono |
| 10,060,349 | B2 | 8/2018 | álvarez et al. |
| 10,077,933 | B2 | 9/2018 | Nelson et al. |
| 10,082,137 | B2 | 9/2018 | Graham et al. |
| 10,094,366 | B2 | 10/2018 | Marica |
| 10,100,827 | B2 | 10/2018 | Devan et al. |
| 10,107,084 | B2 | 10/2018 | Coli et al. |
| 10,107,085 | B2 | 10/2018 | Coli et al. |
| 10,114,061 | B2 | 10/2018 | Frampton et al. |
| 10,119,381 | B2 | 11/2018 | Oehring et al. |
| 10,125,750 | B2 | 11/2018 | Pfaff |
| 10,134,257 | B2 | 11/2018 | Zhang et al. |
| 10,138,098 | B2 | 11/2018 | SøRensen et al. |
| 10,151,244 | B2 | 12/2018 | Giancotti et al. |

(56) References Cited

U.S. PATENT DOCUMENTS 10,161,423 B2 12/2018 Rampen
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.
10,254,732 B2 4/2019 Oehring et al.
10,267,439 B2 4/2019 Pryce et al.
10,280,724 B2 5/2019 Hinderliter
10,287,943 B1 5/2019 Schiltz
10,288,519 B2 5/2019 De La Cruz
10,303,190 B2 5/2019 Shock
10,305,350 B2 5/2019 Johnson et al.
10,316,832 B2 6/2019 Byrne
10,317,875 B2 6/2019 Pandurangan et al.
10,337,402 B2 7/2019 Austin et al.
10,358,035 B2 7/2019 Cryer
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 9/2019 Kajita et al.
RE47,695 E 11/2019 Case et al.
10,465,689 B2 11/2019 Crom
10,478,753 B1 11/2019 Elms et al.
10,526,882 B2 1/2020 Oehring et al.
10,563,649 B2 2/2020 Zhang et al.
10,577,910 B2 3/2020 Stephenson
10,584,645 B2 3/2020 Nakagawa et al.
10,590,867 B2 3/2020 Thomassin et al.
10,598,258 B2 3/2020 Oehring et al.
10,610,842 B2 4/2020 Chong
10,662,749 B1 5/2020 Hill et al.
10,711,787 B1 7/2020 Darley
10,738,580 B1 8/2020 Fischer et al.
10,753,153 B1 8/2020 Fischer et al.
10,753,165 B1 8/2020 Fischer et al.
10,760,556 B1 9/2020 Crom et al.
10,794,165 B2 10/2020 Fischer et al.
10,794,166 B2 10/2020 Reckels et al.
10,801,311 B1 10/2020 Cui et al.
10,815,764 B1 10/2020 Yeung et al.
10,815,978 B2 10/2020 Glass
10,830,032 B1 11/2020 Zhang et al.
10,830,225 B2 11/2020 Repaci
10,859,203 B1 12/2020 Cui et al.
10,864,487 B1 12/2020 Han et al.
10,865,624 B1 12/2020 Cui et al.
10,865,631 B1 12/2020 Zhang et al.
10,870,093 B1 12/2020 Zhong et al.
10,871,045 B2 12/2020 Fischer et al.
10,895,202 B1 1/2021 Yeung et al.
10,900,475 B2 1/2021 Weightman et al.
10,907,459 B1 2/2021 Yeung et al.
10,927,774 B2 2/2021 Cai et al.
10,927,802 B2 2/2021 Oehring
10,954,770 B1 3/2021 Yeung et al.
10,954,855 B1 3/2021 Ji et al.
10,961,908 B1 3/2021 Yeung et al.
10,961,912 B1 3/2021 Yeung et al.
10,961,914 B1 3/2021 Yeung et al.
10,961,993 B1 3/2021 Ji et al.
10,961,995 B2 3/2021 Mayorca
10,982,523 B1 4/2021 Hill et al.
10,989,019 B2 4/2021 Cai et al.
10,995,564 B2 5/2021 Miller et al.
11,002,189 B2 5/2021 Yeung et al.
11,008,950 B2 5/2021 Ethier et al.
11,015,423 B1 5/2021 Yeung et al.
11,035,213 B2 6/2021 Dusterhoft et al.
11,035,214 B2 6/2021 Cui et al.
11,047,379 B1 6/2021 Li et al.
11,053,853 B2 7/2021 Li et al.
11,060,455 B1 7/2021 Yeung et al.
11,068,455 B2 7/2021 Shabi et al.
11,085,281 B1 8/2021 Yeung et al.
11,085,282 B2 8/2021 Mazrooee et al.
11,105,250 B1 8/2021 Zhang et al.
11,105,266 B2 8/2021 Zhou et al.
11,125,156 B2 9/2021 Zhang et al.
11,143,000 B2 10/2021 Li et al.
11,143,006 B1 10/2021 Zhang et al.
11,168,681 B2 11/2021 Boguski
11,236,739 B2 2/2022 Yeung et al.
11,242,737 B2 2/2022 Zhang et al.
11,243,509 B2 2/2022 Cai et al.
11,251,650 B1 2/2022 Liu et al.
11,261,717 B2 3/2022 Yeung et al.
11,268,346 B2 3/2022 Yeung et al.
11,280,266 B2 3/2022 Yeung et al.
RE49,083 E 5/2022 Case et al.
11,339,638 B1 5/2022 Yeung et al.
11,346,200 B2 5/2022 Cai et al.
11,373,058 B2 6/2022 Jaaskelainen et al.
RE49,140 E 7/2022 Case et al.
11,377,943 B2 7/2022 Kriebel et al.
RE49,155 E 8/2022 Case et al.
RE49,156 E 8/2022 Case et al.
11,401,927 B2 8/2022 Li et al.
11,441,483 B2 9/2022 Li et al.
11,448,122 B2 9/2022 Feng et al.
11,466,680 B2 10/2022 Yeung et al.
11,480,040 B2 10/2022 Han et al.
11,492,887 B2 11/2022 Cui et al.
11,499,405 B2 11/2022 Zhang et al.
11,506,039 B2 11/2022 Zhang et al.
11,512,570 B2 11/2022 Yeung
11,519,395 B2 12/2022 Zhang et al.
11,519,405 B2 12/2022 Deng et al.
11,530,602 B2 12/2022 Yeung et al.
11,549,349 B2 1/2023 Wang et al.
11,555,390 B2 1/2023 Cui et al.
11,557,887 B2 1/2023 Ji et al.
11,560,779 B2 1/2023 Mao et al.
2002/0126922 A1 9/2002 Cheng et al.
2002/0197176 A1 12/2002 Kondo
2003/0031568 A1 2/2003 Stiefel
2003/0061819 A1 4/2003 Kuroki et al.
2003/0161212 A1 8/2003 Neal et al.
2004/0016245 A1 1/2004 Pierson
2004/0074238 A1 4/2004 Wantanabe et al.
2004/0076526 A1 4/2004 Fukano et al.
2004/0187950 A1 9/2004 Cohen et al.
2004/0219040 A1 11/2004 Kugelev et al.
2005/0051322 A1 3/2005 Speer
2005/0056081 A1 3/2005 Gocho
2005/0139286 A1 6/2005 Poulter
2005/0196298 A1 9/2005 Manning
2005/0226754 A1 10/2005 Orr et al.
2005/0274134 A1 12/2005 Ryu et al.
2006/0061091 A1 3/2006 Osterloh
2006/0062914 A1 3/2006 Garg et al.
2006/0196251 A1 9/2006 Richey
2006/0211356 A1 9/2006 Grassman
2006/0260331 A1 11/2006 Andreychuk
2006/0272333 A1 12/2006 Sundin
2007/0029090 A1 2/2007 Andreychuk et al.
2007/0041848 A1 2/2007 Wood et al.
2007/0066406 A1 3/2007 Keller et al.
2007/0098580 A1 5/2007 Petersen
2007/0107981 A1 5/2007 Sicotte
2007/0125544 A1 6/2007 Robinson et al.
2007/0169543 A1 7/2007 Fazekas
2007/0181212 A1 8/2007 Fell
2007/0277982 A1* 12/2007 Shampine ..... E21B 43/16
166/308.1
2007/0295569 A1 12/2007 Manzoor et al.

(56) References Cited

U.S. PATENT DOCUMENTS

2008/0006089 A1 1/2008 Adnan et al.
2008/0098891 A1 5/2008 Feher
2008/0161974 A1 7/2008 Alston
2008/0229757 A1 9/2008 Alexander et al.
2008/0264625 A1 10/2008 Ochoa
2008/0264649 A1 10/2008 Crawford
2008/0298982 A1 12/2008 Pabst
2009/0064685 A1 3/2009 Busekros et al.
2009/0068031 A1 3/2009 Gambier et al.
2009/0092510 A1 4/2009 Williams et al.
2009/0124191 A1 5/2009 Van Becelaere et al.
2009/0178412 A1 7/2009 Spytek
2009/0212630 A1 8/2009 Flegel et al.
2009/0249794 A1* 10/2009 Wilkes ..... H02P 9/04 60/773
2009/0252616 A1 10/2009 Brunet et al.
2009/0308602 A1 12/2009 Bruins et al.
2010/0019626 A1 1/2010 Stout et al.
2010/0071899 A1 3/2010 Coquilleau et al.
2010/0218508 A1 9/2010 Brown et al.
2010/0300683 A1 12/2010 Looper et al.
2010/0310384 A1 12/2010 Stephenson et al.
2011/0041681 A1 2/2011 Duerr
2011/0052423 A1 3/2011 Gambier et al.
2011/0054704 A1 3/2011 Karpman et al.
2011/0085924 A1 4/2011 Shampine et al.
2011/0146244 A1 6/2011 Farman et al.
2011/0146246 A1 6/2011 Farman et al.
2011/0173991 A1 7/2011 Dean
2011/0197988 A1 8/2011 Van Vliet et al.
2011/0241888 A1 10/2011 Lu et al.
2011/0265443 A1 11/2011 Ansari
2011/0272158 A1 11/2011 Neal
2012/0023973 A1 2/2012 Mayorca
2012/0048242 A1 3/2012 Sumilla et al.
2012/0085541 A1 4/2012 Love et al.
2012/0137699 A1 6/2012 Montagne et al.
2012/0179444 A1 7/2012 Ganguly et al.
2012/0192542 A1 8/2012 Chillar et al.
2012/0199001 A1 8/2012 Chillar et al.
2012/0204627 A1 8/2012 Anderl et al.
2012/0255734 A1 10/2012 Coli et al.
2012/0310509 A1 12/2012 Pardo et al.
2012/0324903 A1 12/2012 Dewis et al.
2013/0068307 A1 3/2013 Hains et al.
2013/0087045 A1 4/2013 Sullivan et al.
2013/0087945 A1 4/2013 Kusters et al.
2013/0134702 A1 5/2013 Boraas et al.
2013/0189915 A1 7/2013 Hazard
2013/0233165 A1 9/2013 Matzner et al.
2013/0255953 A1 10/2013 Tudor
2013/0259707 A1 10/2013 Yin
2013/0284455 A1 10/2013 Kajaria et al.
2013/0300341 A1 11/2013 Gillette
2013/0306322 A1 11/2013 Sanborn
2014/0010671 A1 1/2014 Cryer et al.
2014/0013768 A1 1/2014 Laing et al.
2014/0032082 A1 1/2014 Gehrke et al.
2014/0044517 A1 2/2014 Saha et al.
2014/0048253 A1 2/2014 Andreychuk
2014/0090729 A1 4/2014 Coulter et al.
2014/0090742 A1 4/2014 Coskrey et al.
2014/0094105 A1 4/2014 Lundh et al.
2014/0095114 A1 4/2014 Thomeer et al.
2014/0095554 A1 4/2014 Thomeer et al.
2014/0123621 A1 5/2014 Driessens et al.
2014/0130422 A1 5/2014 Laing et al.
2014/0138079 A1 5/2014 Broussard et al.
2014/0144641 A1 5/2014 Chandler
2014/0147291 A1 5/2014 Burnette
2014/0158345 A1 6/2014 Jang et al.
2014/0196459 A1 7/2014 Futa et al.
2014/0216736 A1 8/2014 Leugemors et al.
2014/0219824 A1 8/2014 Burnette
2014/0250845 A1 9/2014 Jackson et al.
2014/0251623 A1 9/2014 Lestz et al.
2014/0277772 A1 9/2014 Lopez et al.
2014/0290266 A1 10/2014 Veilleux, Jr. et al.
2014/0318638 A1 10/2014 Harwood et al.
2014/0322050 A1 10/2014 Marette et al.
2015/0027730 A1 1/2015 Hall et al.
2015/0078924 A1 3/2015 Zhang et al.
2015/0101344 A1 4/2015 Jarrier et al.
2015/0114652 A1 4/2015 Lestz et al.
2015/0129210 A1 5/2015 Chong et al.
2015/0135659 A1 5/2015 Jarrier et al.
2015/0159553 A1 6/2015 Kippel et al.
2015/0192117 A1 7/2015 Bridges
2015/0204148 A1 7/2015 Liu et al.
2015/0204322 A1 7/2015 Iund et al.
2015/0211512 A1 7/2015 Wiegman et al.
2015/0214816 A1 7/2015 Raad
2015/0217672 A1 8/2015 Shampine et al.
2015/0226140 A1 8/2015 Zhang et al.
2015/0252661 A1 9/2015 Glass
2015/0275891 A1 10/2015 Chong et al.
2015/0337730 A1 11/2015 Kupiszewski et al.
2015/0340864 A1 11/2015 Compton
2015/0345385 A1 12/2015 Santini
2015/0369351 A1 12/2015 Hermann et al.
2016/0032703 A1* 2/2016 Broussard ..... E21B 43/26 166/250.01
2016/0032836 A1 2/2016 Hawkinson et al.
2016/0102581 A1 4/2016 Del Bono
2016/0105022 A1 4/2016 Oehring et al.
2016/0108713 A1 4/2016 Dunaeva et al.
2016/0168979 A1 6/2016 Zhang et al.
2016/0177675 A1 6/2016 Morris et al.
2016/0177945 A1 6/2016 Byrne et al.
2016/0186671 A1 6/2016 Austin et al.
2016/0195082 A1 7/2016 Wiegman et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0258267 A1 9/2016 Payne et al.
2016/0273328 A1 9/2016 Oehring
2016/0273346 A1 9/2016 Tang et al.
2016/0290114 A1 10/2016 Oehring et al.
2016/0319650 A1 11/2016 Oehring et al.
2016/0326845 A1 11/2016 Djikpesse et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0045055 A1 2/2017 Hoefel et al.
2017/0052087 A1 2/2017 Faqihi et al.
2017/0074074 A1 3/2017 Joseph et al.
2017/0074076 A1 3/2017 Joseph et al.
2017/0074089 A1 3/2017 Agarwal et al.
2017/0082110 A1 3/2017 Lammers
2017/0089189 A1 3/2017 Norris et al.
2017/0114613 A1 4/2017 Lecerf et al.
2017/0114625 A1* 4/2017 Norris ..... F04B 51/00
2017/0122310 A1 5/2017 Ladron de Guevara
2017/0131174 A1 5/2017 Enev et al.
2017/0145918 A1 5/2017 Oehring et al.
2017/0191350 A1 7/2017 Johns et al.
2017/0218727 A1 8/2017 Oehring et al.
2017/0226839 A1 8/2017 Broussard et al.
2017/0226842 A1 8/2017 Omont et al.
2017/0226998 A1 8/2017 Zhang et al.
2017/0227002 A1 8/2017 Mikulski et al.
2017/0233103 A1 8/2017 Teicholz et al.
2017/0234165 A1 8/2017 Kersey et al.
2017/0234308 A1 8/2017 Buckley
2017/0241336 A1 8/2017 Jones et al.
2017/0248034 A1 8/2017 Dzieciol et al.
2017/0248208 A1 8/2017 Tamura
2017/0248308 A1 8/2017 Makarychev-Mikhailov et al.
2017/0275149 A1 9/2017 Schmidt

(56) References Cited

U.S. PATENT DOCUMENTS

2017/0288400 A1 10/2017 Williams
2017/0292409 A1 10/2017 Aguilar et al.
2017/0302135 A1 10/2017 Cory
2017/0305736 A1 10/2017 Haile et al.
2017/0306847 A1 10/2017 Suciu et al.
2017/0306936 A1 10/2017 Dole
2017/0322086 A1* 11/2017 Luharuka ..... G01J 5/48
2017/0333086 A1 11/2017 Jackson
2017/0334448 A1 11/2017 Schwunk
2017/0335842 A1 11/2017 Robinson et al.
2017/0350471 A1 12/2017 Steidl et al.
2017/0370199 A1 12/2017 Witkowski et al.
2017/0370480 A1 12/2017 Witkowski et al.
2018/0034280 A1 2/2018 Pedersen
2018/0038328 A1 2/2018 Louven et al.
2018/0041093 A1 2/2018 Miranda
2018/0045202 A1 2/2018 Crom
2018/0038216 A1 3/2018 Zhang et al.
2018/0058171 A1 3/2018 Roesner et al.
2018/0087499 A1 3/2018 Zhang et al.
2018/0087996 A1 3/2018 De La Cruz
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1 7/2018 Hill et al.
2018/0209415 A1 7/2018 Zhang et al.
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0290877 A1 10/2018 Shock
2018/0291781 A1 10/2018 Pedrini
2018/0298731 A1 10/2018 Bishop
2018/0298735 A1 10/2018 Conrad
2018/0307255 A1 10/2018 Bishop
2018/0313456 A1 11/2018 Bayyouk et al.
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0011051 A1 1/2019 Yeung
2019/0048993 A1 2/2019 Akiyama et al.
2019/0063263 A1 2/2019 Davis et al.
2019/0063341 A1 2/2019 Davis
2019/0067991 A1 2/2019 Davis et al.
2019/0071992 A1 3/2019 Feng
2019/0072005 A1 3/2019 Fisher et al.
2019/0078471 A1 3/2019 Braglia et al.
2019/0091619 A1 3/2019 Huang
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0128247 A1 5/2019 Douglas, III
2019/0128288 A1 5/2019 Konada et al.
2019/0131607 A1 5/2019 Gillette
2019/0136677 A1 5/2019 Shampine et al.
2019/0153843 A1 5/2019 Headrick
2019/0153938 A1 5/2019 Hammoud
2019/0154020 A1 5/2019 Glass
2019/0155318 A1 5/2019 Meunier
2019/0264667 A1 5/2019 Byrne
2019/0178234 A1 6/2019 Beisel
2019/0178235 A1 6/2019 Coskrey et al.
2019/0185312 A1 6/2019 Bush et al.
2019/0203572 A1 7/2019 Morris et al.
2019/0204021 A1 7/2019 Morris et al.
2019/0211661 A1 7/2019 Reckies et al.
2019/0211814 A1 7/2019 Weightman et al.
2019/0217258 A1 7/2019 Bishop
2019/0226317 A1 7/2019 Payne et al.
2019/0245348 A1 8/2019 Hinderliter et al.
2019/0249652 A1 8/2019 Stephenson et al.
2019/0249754 A1 8/2019 Oehring et al.
2019/0257297 A1 8/2019 Botting et al.
2019/0277279 A1 9/2019 Byrne et al.
2019/0277295 A1 9/2019 Clyburn et al.
2019/0309585 A1 10/2019 Miller et al.
2019/0316447 A1 10/2019 Oehring et al.
2019/0316456 A1 10/2019 Beisel et al.
2019/0323337 A1 10/2019 Glass et al.
2019/0330923 A1 10/2019 Gable et al.
2019/0331117 A1 10/2019 Gable et al.
2019/0337392 A1 11/2019 Joshi et al.
2019/0338762 A1 11/2019 Curry et al.
2019/0345920 A1 11/2019 Surjaatmadja et al.
2019/0353103 A1 11/2019 Roberge
2019/0356199 A1 11/2019 Morris et al.
2019/0376449 A1 12/2019 Carrell
2019/0383123 A1 12/2019 Hinderliter
2020/0003205 A1 1/2020 Stokkevag et al.
2020/0011165 A1 1/2020 George et al.
2020/0040878 A1 2/2020 Morris
2020/0049136 A1 2/2020 Stephenson
2020/0049153 A1 2/2020 Headrick et al.
2020/0071998 A1 3/2020 Oehring et al.
2020/0072201 A1 3/2020 Marica
2020/0088202 A1 3/2020 Sigmar et al.
2020/0095854 A1 3/2020 Hinderliter
2020/0109610 A1 4/2020 Husoy et al.
2020/0132058 A1 4/2020 Mollatt
2020/0141219 A1 5/2020 Oehring et al.
2020/0141326 A1 5/2020 Redford et al.
2020/0141907 A1 5/2020 Meck et al.
2020/0166026 A1 5/2020 Marica
2020/0206704 A1 7/2020 Chong
2020/0208733 A1 7/2020 Kim
2020/0223648 A1 7/2020 Herman et al.
2020/0224645 A1 7/2020 Buckley
2020/0232454 A1 7/2020 Chretien et al.
2020/0256333 A1 8/2020 Surjaatmadja
2020/0263498 A1 8/2020 Fischer et al.
2020/0263525 A1 8/2020 Reid
2020/0263526 A1 8/2020 Fischer et al.
2020/0263527 A1 8/2020 Fischer et al.
2020/0263528 A1 8/2020 Fischer et al.
2020/0267888 A1 8/2020 Putz
2020/0291731 A1 9/2020 Haiderer et al.
2020/0295574 A1 9/2020 Batsch-Smith
2020/0300050 A1 9/2020 Oehring et al.
2020/0309113 A1 10/2020 Hunter et al.
2020/0325752 A1 10/2020 Clark et al.
2020/0325760 A1 10/2020 Markham
2020/0325761 A1 10/2020 Williams
2020/0325893 A1 10/2020 Kraige et al.
2020/0332784 A1 10/2020 Zhang et al.
2020/0332788 A1 10/2020 Cui et al.
2020/0340313 A1 10/2020 Fischer et al.
2020/0340340 A1 10/2020 Oehring et al.
2020/0340344 A1 10/2020 Reckels et al.
2020/0340404 A1 10/2020 Stockstill
2020/0347725 A1 11/2020 Morris et al.
2020/0354928 A1 11/2020 Wehler et al.
2020/0362760 A1 11/2020 Morenko et al.
2020/0362764 A1 11/2020 Saintignan et al.
2020/0370394 A1 11/2020 Cai et al.
2020/0370408 A1 11/2020 Cai et al.
2020/0370429 A1 11/2020 Cai et al.
2020/0371490 A1 11/2020 Cai et al.

(56) References Cited

U.S. PATENT DOCUMENTS

| | | | |
|---|---|---|---|
| 2020/0340322 | A1 | 12/2020 | Sizemore et al. |
| 2020/0386222 | A1 | 12/2020 | Pham et al. |
| 2020/0388140 | A1 | 12/2020 | Gomez et al. |
| 2020/0392826 | A1 | 12/2020 | Cui et al. |
| 2020/0392827 | A1 | 12/2020 | George et al. |
| 2020/0393088 | A1 | 12/2020 | Sizemore et al. |
| 2020/0398238 | A1 | 12/2020 | Zhong et al. |
| 2020/0400000 | A1 | 12/2020 | Ghasripoor et al. |
| 2020/0400005 | A1 | 12/2020 | Han et al. |
| 2020/0407625 | A1 | 12/2020 | Stephenson |
| 2020/0408071 | A1 | 12/2020 | Li et al. |
| 2020/0408144 | A1 | 12/2020 | Feng et al. |
| 2020/0408147 | A1 | 12/2020 | Zhang et al. |
| 2020/0408149 | A1 | 12/2020 | Li et al. |
| 2021/0025324 | A1 | 1/2021 | Morris et al. |
| 2021/0025383 | A1 | 1/2021 | Bodishbaugh et al. |
| 2021/0032961 | A1 | 2/2021 | Hinderliter et al. |
| 2021/0054727 | A1 | 2/2021 | Floyd |
| 2021/0071503 | A1 | 3/2021 | Ogg et al. |
| 2021/0071574 | A1 | 3/2021 | Feng et al. |
| 2021/0071579 | A1 | 3/2021 | Li et al. |
| 2021/0071654 | A1 | 3/2021 | Brunson |
| 2021/0071752 | A1 | 3/2021 | Cui et al. |
| 2021/0079758 | A1 | 3/2021 | Yeung et al. |
| 2021/0079851 | A1 | 3/2021 | Yeung et al. |
| 2021/0086851 | A1 | 3/2021 | Zhang et al. |
| 2021/0087883 | A1 | 3/2021 | Zhang et al. |
| 2021/0087916 | A1 | 3/2021 | Zhang et al. |
| 2021/0087925 | A1 | 3/2021 | Heidari et al. |
| 2021/0087943 | A1 | 3/2021 | Cui et al. |
| 2021/0088042 | A1 | 3/2021 | Zhang et al. |
| 2021/0123425 | A1 | 4/2021 | Cui et al. |
| 2021/0123434 | A1 | 4/2021 | Cui et al. |
| 2021/0123435 | A1 | 4/2021 | Cui et al. |
| 2021/0131409 | A1 | 5/2021 | Cui et al. |
| 2021/0140416 | A1 | 5/2021 | Buckley |
| 2021/0148208 | A1 | 5/2021 | Thomas et al. |
| 2021/0156240 | A1 | 5/2021 | Cicci et al. |
| 2021/0156241 | A1 | 5/2021 | Cook |
| 2021/0172282 | A1 | 6/2021 | Wang et al. |
| 2021/0180517 | A1 | 6/2021 | Zhou et al. |
| 2021/0199110 | A1 | 7/2021 | Albert et al. |
| 2021/0222690 | A1 | 7/2021 | Beisel |
| 2021/0239112 | A1 | 8/2021 | Buckley |
| 2021/0246774 | A1 | 8/2021 | Cui et al. |
| 2021/0270261 | A1 | 9/2021 | Zhang et al. |
| 2021/0270264 | A1 | 9/2021 | Byrne |
| 2021/0285311 | A1 | 9/2021 | Ji et al. |
| 2021/0285432 | A1 | 9/2021 | Ji et al. |
| 2021/0301807 | A1 | 9/2021 | Cui et al. |
| 2021/0306720 | A1 | 9/2021 | Sandoval et al. |
| 2021/0308638 | A1 | 10/2021 | Zhong et al. |
| 2021/0348475 | A1 | 11/2021 | Yeung et al. |
| 2021/0348476 | A1 | 11/2021 | Yeung et al. |
| 2021/0348477 | A1 | 11/2021 | Yeung et al. |
| 2021/0355927 | A1 | 11/2021 | Jian et al. |
| 2021/0372394 | A1 | 12/2021 | Bagulayan et al. |
| 2021/0372395 | A1 | 12/2021 | Li et al. |
| 2021/0388760 | A1 | 12/2021 | Feng et al. |
| 2022/0082007 | A1 | 3/2022 | Zhang et al. |
| 2022/0090476 | A1 | 3/2022 | Zhang et al. |
| 2022/0090477 | A1 | 3/2022 | Zhang et al. |
| 2022/0090478 | A1 | 3/2022 | Zhang et al. |
| 2022/0112892 | A1 | 4/2022 | Cui et al. |
| 2022/0120262 | A1 | 4/2022 | Ji et al. |
| 2022/0145740 | A1 | 5/2022 | Yuan et al. |
| 2022/0154775 | A1 | 5/2022 | Liu et al. |
| 2022/0155373 | A1 | 5/2022 | Liu et al. |
| 2022/0162931 | A1 | 5/2022 | Zhong et al. |
| 2022/0162991 | A1 | 5/2022 | Zhang et al. |
| 2022/0181859 | A1 | 6/2022 | Ji et al. |
| 2022/0186724 | A1 | 6/2022 | Chang et al. |
| 2022/0213777 | A1 | 7/2022 | Cui et al. |
| 2022/0220836 | A1 | 7/2022 | Zhang et al. |
| 2022/0224087 | A1 | 7/2022 | Ji et al. |
| 2022/0228468 | A1 | 7/2022 | Cui et al. |
| 2022/0228469 | A1 | 7/2022 | Zhang et al. |
| 2022/0235639 | A1 | 7/2022 | Zhang et al. |
| 2022/0235640 | A1 | 7/2022 | Mao et al. |
| 2022/0235641 | A1 | 7/2022 | Zhang et al. |
| 2022/0235642 | A1 | 7/2022 | Zhang et al. |
| 2022/0235802 | A1 | 7/2022 | Jiang et al. |
| 2022/0242297 | A1 | 8/2022 | Tian et al. |
| 2022/0243613 | A1 | 8/2022 | Ji et al. |
| 2022/0243724 | A1 | 8/2022 | Li et al. |
| 2022/0250000 | A1 | 8/2022 | Zhang et al. |
| 2022/0255319 | A1 | 8/2022 | Liu et al. |
| 2022/0258659 | A1 | 8/2022 | Cui et al. |
| 2022/0259947 | A1 | 8/2022 | Li et al. |
| 2022/0259964 | A1 | 8/2022 | Zhang et al. |
| 2022/0268201 | A1 | 8/2022 | Feng et al. |
| 2022/0282606 | A1 | 9/2022 | Zhong et al. |
| 2022/0282726 | A1 | 9/2022 | Zhang et al. |
| 2022/0290549 | A1 | 9/2022 | Zhang et al. |
| 2022/0294194 | A1 | 9/2022 | Cao et al. |
| 2022/0298906 | A1 | 9/2022 | Zhong et al. |
| 2022/0307359 | A1 | 9/2022 | Liu et al. |
| 2022/0307424 | A1 | 9/2022 | Wang et al. |
| 2022/0314248 | A1 | 10/2022 | Ge et al. |
| 2022/0315347 | A1 | 10/2022 | Liu et al. |
| 2022/0316306 | A1 | 10/2022 | Liu et al. |
| 2022/0316362 | A1 | 10/2022 | Zhang et al. |
| 2022/0316461 | A1 | 10/2022 | Wang et al. |
| 2022/0325608 | A1 | 10/2022 | Zhang et al. |
| 2022/0330411 | A1 | 10/2022 | Liu et al. |
| 2022/0333471 | A1 | 10/2022 | Zhong et al. |
| 2022/0339646 | A1 | 10/2022 | Yu et al. |
| 2022/0341358 | A1 | 10/2022 | Ji et al. |
| 2022/0341362 | A1 | 10/2022 | Feng et al. |
| 2022/0341415 | A1 | 10/2022 | Deng et al. |
| 2022/0345007 | A1 | 10/2022 | Liu et al. |
| 2022/0349345 | A1 | 11/2022 | Zhang et al. |
| 2022/0353980 | A1 | 11/2022 | Liu et al. |
| 2022/0361309 | A1 | 11/2022 | Liu et al. |
| 2022/0364452 | A1 | 11/2022 | Wang et al. |
| 2022/0364453 | A1 | 11/2022 | Chang et al. |
| 2022/0372865 | A1 | 11/2022 | Lin et al. |
| 2022/0376280 | A1 | 11/2022 | Shao et al. |
| 2022/0381126 | A1 | 12/2022 | Cui et al. |
| 2022/0389799 | A1 | 12/2022 | Mao |
| 2022/0389803 | A1 | 12/2022 | Zhang et al. |
| 2022/0389804 | A1 | 12/2022 | Cui et al. |
| 2022/0389865 | A1 | 12/2022 | Feng et al. |
| 2022/0389867 | A1 | 12/2022 | Li et al. |
| 2022/0412196 | A1 | 12/2022 | Cui et al. |
| 2022/0412199 | A1 | 12/2022 | Mao et al. |
| 2022/0412200 | A1 | 12/2022 | Zhang et al. |
| 2022/0412258 | A1 | 12/2022 | Li et al. |
| 2022/0412379 | A1 | 12/2022 | Wang et al. |
| 2023/0001524 | A1 | 1/2023 | Jiang et al. |
| 2023/0003238 | A1 | 1/2023 | Du et al. |
| 2023/0015132 | A1 | 1/2023 | Feng et al. |
| 2023/0015529 | A1 | 1/2023 | Zhang et al. |
| 2023/0015581 | A1 | 1/2023 | Ji et al. |
| 2023/0017968 | A1 | 1/2023 | Deng et al. |

FOREIGN PATENT DOCUMENTS

| | | | |
|---|---|---|---|
| CA | 2043184 | | 8/1994 |
| CA | 2829762 | | 9/2012 |
| CA | 2876687 | A1 | 5/2014 |
| CA | 2693567 | | 9/2014 |
| CA | 2964597 | | 10/2017 |
| CA | 2876687 | C | 4/2019 |
| CA | 3138533 | | 11/2020 |
| CA | 2919175 | | 3/2021 |
| CN | 2622404 | | 6/2004 |
| CN | 2779054 | | 5/2006 |
| CN | 2890325 | | 4/2007 |
| CN | 200964929 | Y | 10/2007 |
| CN | 101323151 | A | 12/2008 |
| CN | 201190660 | Y | 2/2009 |
| CN | 201190892 | Y | 2/2009 |
| CN | 201190893 | Y | 2/2009 |

(56) References Cited

FOREIGN PATENT DOCUMENTS

| | | | |
|---|---|---|---|
| CN | 101414171 | A | 4/2009 |
| CN | 201215073 | Y | 4/2009 |
| CN | 201236650 | Y | 5/2009 |
| CN | 201275542 | Y | 7/2009 |
| CN | 201275801 | Y | 7/2009 |
| CN | 201333385 | Y | 10/2009 |
| CN | 201443300 | U | 4/2010 |
| CN | 201496415 | U | 6/2010 |
| CN | 201501365 | U | 6/2010 |
| CN | 201507271 | U | 6/2010 |
| CN | 101323151 | B | 7/2010 |
| CN | 201560210 | U | 8/2010 |
| CN | 201581862 | U | 9/2010 |
| CN | 201610728 | U | 10/2010 |
| CN | 201610751 | U | 10/2010 |
| CN | 201618530 | U | 11/2010 |
| CN | 201661255 | U | 12/2010 |
| CN | 101949382 | | 1/2011 |
| CN | 201756927 | U | 3/2011 |
| CN | 101414171 | B | 5/2011 |
| CN | 102128011 | A | 7/2011 |
| CN | 102140898 | A | 8/2011 |
| CN | 102155172 | A | 8/2011 |
| CN | 102182904 | | 9/2011 |
| CN | 202000930 | U | 10/2011 |
| CN | 202055781 | U | 11/2011 |
| CN | 202082265 | U | 12/2011 |
| CN | 202100216 | U | 1/2012 |
| CN | 202100217 | U | 1/2012 |
| CN | 202100815 | U | 1/2012 |
| CN | 202124340 | U | 1/2012 |
| CN | 202140051 | U | 2/2012 |
| CN | 202140080 | U | 2/2012 |
| CN | 202144789 | U | 2/2012 |
| CN | 202144943 | U | 2/2012 |
| CN | 202149354 | U | 2/2012 |
| CN | 102383748 | A | 3/2012 |
| CN | 202156297 | U | 3/2012 |
| CN | 202158355 | U | 3/2012 |
| CN | 202163504 | U | 3/2012 |
| CN | 202165236 | U | 3/2012 |
| CN | 202180866 | U | 4/2012 |
| CN | 202181875 | U | 4/2012 |
| CN | 202187744 | U | 4/2012 |
| CN | 202191854 | U | 4/2012 |
| CN | 202250008 | U | 5/2012 |
| CN | 101885307 | | 7/2012 |
| CN | 102562020 | A | 7/2012 |
| CN | 202326156 | U | 7/2012 |
| CN | 202370773 | U | 8/2012 |
| CN | 202417397 | U | 9/2012 |
| CN | 202417461 | U | 9/2012 |
| CN | 102729335 | A | 10/2012 |
| CN | 202463955 | U | 10/2012 |
| CN | 202463957 | U | 10/2012 |
| CN | 202467739 | U | 10/2012 |
| CN | 202467801 | U | 10/2012 |
| CN | 202531016 | U | 11/2012 |
| CN | 202544794 | U | 11/2012 |
| CN | 102825039 | A | 12/2012 |
| CN | 202578592 | U | 12/2012 |
| CN | 202579164 | U | 12/2012 |
| CN | 202594808 | U | 12/2012 |
| CN | 202594928 | U | 12/2012 |
| CN | 202596615 | U | 12/2012 |
| CN | 202596616 | U | 12/2012 |
| CN | 102849880 | A | 1/2013 |
| CN | 102889191 | A | 1/2013 |
| CN | 202641535 | U | 1/2013 |
| CN | 202645475 | U | 1/2013 |
| CN | 202666716 | U | 1/2013 |
| CN | 202669645 | U | 1/2013 |
| CN | 202669944 | U | 1/2013 |
| CN | 202671336 | U | 1/2013 |
| CN | 202673269 | U | 1/2013 |
| CN | 202751982 | U | 2/2013 |
| CN | 102963629 | A | 3/2013 |
| CN | 202767964 | U | 3/2013 |
| CN | 202789791 | U | 3/2013 |
| CN | 202789792 | U | 3/2013 |
| CN | 202810717 | U | 3/2013 |
| CN | 202827276 | U | 3/2013 |
| CN | 202833093 | U | 3/2013 |
| CN | 202833370 | U | 3/2013 |
| CN | 102140898 | B | 4/2013 |
| CN | 202895467 | U | 4/2013 |
| CN | 202926404 | U | 5/2013 |
| CN | 202935216 | U | 5/2013 |
| CN | 202935798 | U | 5/2013 |
| CN | 202935816 | U | 5/2013 |
| CN | 202970631 | U | 6/2013 |
| CN | 103223315 | A | 7/2013 |
| CN | 203050598 | U | 7/2013 |
| CN | 103233714 | A | 8/2013 |
| CN | 103233715 | A | 8/2013 |
| CN | 103245523 | A | 8/2013 |
| CN | 103247220 | A | 8/2013 |
| CN | 103253839 | A | 8/2013 |
| CN | 103277290 | A | 9/2013 |
| CN | 103321782 | A | 9/2013 |
| CN | 203170270 | U | 9/2013 |
| CN | 203172509 | U | 9/2013 |
| CN | 203175778 | U | 9/2013 |
| CN | 203175787 | U | 9/2013 |
| CN | 102849880 | B | 10/2013 |
| CN | 203241231 | U | 10/2013 |
| CN | 203244941 | U | 10/2013 |
| CN | 203244942 | U | 10/2013 |
| CN | 203303798 | U | 11/2013 |
| CN | 102155172 | B | 12/2013 |
| CN | 102729335 | B | 12/2013 |
| CN | 103420532 | A | 12/2013 |
| CN | 203321792 | U | 12/2013 |
| CN | 203412658 | | 1/2014 |
| CN | 203420697 | U | 2/2014 |
| CN | 203480755 | U | 3/2014 |
| CN | 103711437 | A | 4/2014 |
| CN | 203531815 | U | 4/2014 |
| CN | 203531871 | U | 4/2014 |
| CN | 203531883 | U | 4/2014 |
| CN | 203556164 | U | 4/2014 |
| CN | 203558809 | U | 4/2014 |
| CN | 203559861 | U | 4/2014 |
| CN | 203559893 | U | 4/2014 |
| CN | 203560189 | U | 4/2014 |
| CN | 102704870 | B | 5/2014 |
| CN | 203611843 | U | 5/2014 |
| CN | 203612531 | U | 5/2014 |
| CN | 203612843 | U | 5/2014 |
| CN | 203614062 | U | 5/2014 |
| CN | 203614388 | U | 5/2014 |
| CN | 203621045 | U | 6/2014 |
| CN | 203621046 | U | 6/2014 |
| CN | 203621051 | U | 6/2014 |
| CN | 203640993 | U | 6/2014 |
| CN | 203655221 | U | 6/2014 |
| CN | 103899280 | A | 7/2014 |
| CN | 103923670 | A | 7/2014 |
| CN | 203685052 | U | 7/2014 |
| CN | 203716936 | U | 7/2014 |
| CN | 103990410 | A | 8/2014 |
| CN | 103993869 | A | 8/2014 |
| CN | 203754009 | U | 8/2014 |
| CN | 203754025 | U | 8/2014 |
| CN | 203754341 | U | 8/2014 |
| CN | 203756614 | U | 8/2014 |
| CN | 203770264 | U | 8/2014 |
| CN | 203784519 | U | 8/2014 |
| CN | 203784520 | U | 8/2014 |
| CN | 104057864 | A | 9/2014 |
| CN | 203819819 | U | 9/2014 |
| CN | 203823431 | U | 9/2014 |
| CN | 203835337 | U | 9/2014 |
| CN | 104074500 | A | 10/2014 |

(56) References Cited

FOREIGN PATENT DOCUMENTS

| | | | |
|---|---|---|---|
| CN | 203876633 | U | 10/2014 |
| CN | 203876636 | U | 10/2014 |
| CN | 203877364 | U | 10/2014 |
| CN | 203877365 | U | 10/2014 |
| CN | 203877375 | U | 10/2014 |
| CN | 203877424 | U | 10/2014 |
| CN | 203879476 | U | 10/2014 |
| CN | 203879479 | U | 10/2014 |
| CN | 203890292 | U | 10/2014 |
| CN | 203899476 | U | 10/2014 |
| CN | 203906206 | U | 10/2014 |
| CN | 104150728 | A | 11/2014 |
| CN | 104176522 | A | 12/2014 |
| CN | 104196464 | A | 12/2014 |
| CN | 104234651 | A | 12/2014 |
| CN | 203971841 | U | 12/2014 |
| CN | 203975450 | U | 12/2014 |
| CN | 204020788 | U | 12/2014 |
| CN | 204021980 | U | 12/2014 |
| CN | 204024625 | U | 12/2014 |
| CN | 204051401 | U | 12/2014 |
| CN | 204060661 | U | 12/2014 |
| CN | 104260672 | A | 1/2015 |
| CN | 104314512 | A | 1/2015 |
| CN | 204077478 | U | 1/2015 |
| CN | 204077526 | U | 1/2015 |
| CN | 204078307 | U | 1/2015 |
| CN | 204083051 | U | 1/2015 |
| CN | 204113168 | U | 1/2015 |
| CN | 104340682 | A | 2/2015 |
| CN | 104358536 | A | 2/2015 |
| CN | 104369687 | A | 2/2015 |
| CN | 104402178 | A | 3/2015 |
| CN | 104402185 | A | 3/2015 |
| CN | 104402186 | A | 3/2015 |
| CN | 204209819 | U | 3/2015 |
| CN | 204224560 | U | 3/2015 |
| CN | 204225813 | U | 3/2015 |
| CN | 204225839 | U | 3/2015 |
| CN | 104533392 | A | 4/2015 |
| CN | 104563938 | A | 4/2015 |
| CN | 104563994 | A | 4/2015 |
| CN | 104563995 | A | 4/2015 |
| CN | 104563998 | A | 4/2015 |
| CN | 104564033 | A | 4/2015 |
| CN | 204257122 | U | 4/2015 |
| CN | 204283610 | U | 4/2015 |
| CN | 204283782 | U | 4/2015 |
| CN | 204297682 | U | 4/2015 |
| CN | 204299810 | U | 4/2015 |
| CN | 103223315 | B | 5/2015 |
| CN | 104594857 | A | 5/2015 |
| CN | 104595493 | A | 5/2015 |
| CN | 104612647 | A | 5/2015 |
| CN | 104612928 | A | 5/2015 |
| CN | 104632126 | A | 5/2015 |
| CN | 204325094 | U | 5/2015 |
| CN | 204325098 | U | 5/2015 |
| CN | 204326983 | U | 5/2015 |
| CN | 204326985 | U | 5/2015 |
| CN | 204344040 | U | 5/2015 |
| CN | 204344095 | U | 5/2015 |
| CN | 104727797 | A | 6/2015 |
| CN | 204402414 | U | 6/2015 |
| CN | 204402423 | U | 6/2015 |
| CN | 204402450 | U | 6/2015 |
| CN | 103247220 | B | 7/2015 |
| CN | 104803568 | A | 7/2015 |
| CN | 204436360 | U | 7/2015 |
| CN | 204457524 | U | 7/2015 |
| CN | 204472485 | U | 7/2015 |
| CN | 204473625 | U | 7/2015 |
| CN | 204477303 | U | 7/2015 |
| CN | 204493095 | U | 7/2015 |
| CN | 204493309 | U | 7/2015 |
| CN | 103253839 | B | 8/2015 |
| CN | 104820372 | A | 8/2015 |
| CN | 104832093 | A | 8/2015 |
| CN | 104863523 | A | 8/2015 |
| CN | 204552723 | U | 8/2015 |
| CN | 204553866 | U | 8/2015 |
| CN | 204571831 | U | 8/2015 |
| CN | 204703814 | U | 10/2015 |
| CN | 204703833 | U | 10/2015 |
| CN | 204703834 | U | 10/2015 |
| CN | 105092401 | A | 11/2015 |
| CN | 103233715 | B | 12/2015 |
| CN | 103790927 | | 12/2015 |
| CN | 105207097 | | 12/2015 |
| CN | 204831952 | U | 12/2015 |
| CN | 204899777 | U | 12/2015 |
| CN | 102602323 | | 1/2016 |
| CN | 105240064 | A | 1/2016 |
| CN | 204944834 | | 1/2016 |
| CN | 205042127 | U | 2/2016 |
| CN | 205172478 | U | 4/2016 |
| CN | 103993869 | B | 5/2016 |
| CN | 105536299 | A | 5/2016 |
| CN | 105545207 | A | 5/2016 |
| CN | 205260249 | | 5/2016 |
| CN | 103233714 | B | 6/2016 |
| CN | 104340682 | B | 6/2016 |
| CN | 205297518 | U | 6/2016 |
| CN | 205298447 | U | 6/2016 |
| CN | 205391821 | U | 7/2016 |
| CN | 205400701 | U | 7/2016 |
| CN | 103277290 | B | 8/2016 |
| CN | 104260672 | B | 8/2016 |
| CN | 205477370 | U | 8/2016 |
| CN | 205479153 | U | 8/2016 |
| CN | 205503058 | U | 8/2016 |
| CN | 205503068 | U | 8/2016 |
| CN | 205503089 | U | 8/2016 |
| CN | 105958098 | A | 9/2016 |
| CN | 205599180 | | 9/2016 |
| CN | 205599180 | U | 9/2016 |
| CN | 106121577 | A | 11/2016 |
| CN | 205709587 | | 11/2016 |
| CN | 104612928 | B | 12/2016 |
| CN | 106246120 | A | 12/2016 |
| CN | 205805471 | | 12/2016 |
| CN | 106321045 | A | 1/2017 |
| CN | 205858306 | | 1/2017 |
| CN | 106438310 | A | 2/2017 |
| CN | 205937833 | | 2/2017 |
| CN | 104563994 | B | 3/2017 |
| CN | 206129196 | | 4/2017 |
| CN | 104369687 | B | 5/2017 |
| CN | 106715165 | | 5/2017 |
| CN | 106761561 | A | 5/2017 |
| CN | 105240064 | B | 6/2017 |
| CN | 206237147 | | 6/2017 |
| CN | 206287832 | | 6/2017 |
| CN | 206346711 | | 7/2017 |
| CN | 104563995 | B | 9/2017 |
| CN | 107120822 | | 9/2017 |
| CN | 107143298 | A | 9/2017 |
| CN | 107159046 | A | 9/2017 |
| CN | 107188018 | A | 9/2017 |
| CN | 206496016 | | 9/2017 |
| CN | 104564033 | B | 10/2017 |
| CN | 107234358 | A | 10/2017 |
| CN | 107261975 | A | 10/2017 |
| CN | 206581929 | | 10/2017 |
| CN | 104820372 | B | 12/2017 |
| CN | 105092401 | B | 12/2017 |
| CN | 107476769 | A | 12/2017 |
| CN | 107520526 | A | 12/2017 |
| CN | 206754664 | | 12/2017 |
| CN | 107605427 | A | 1/2018 |
| CN | 106438310 | B | 2/2018 |
| CN | 107654196 | A | 2/2018 |
| CN | 107656499 | A | 2/2018 |
| CN | 107728657 | A | 2/2018 |

(56) References Cited

FOREIGN PATENT DOCUMENTS

| | | | |
|---|---|---|---|
| CN | 206985503 | | 2/2018 |
| CN | 207017968 | | 2/2018 |
| CN | 107859053 | A | 3/2018 |
| CN | 207057867 | | 3/2018 |
| CN | 207085817 | | 3/2018 |
| CN | 105545207 | B | 4/2018 |
| CN | 107883091 | A | 4/2018 |
| CN | 107902427 | A | 4/2018 |
| CN | 107939290 | A | 4/2018 |
| CN | 107956708 | | 4/2018 |
| CN | 207169595 | | 4/2018 |
| CN | 207194873 | | 4/2018 |
| CN | 207245674 | | 4/2018 |
| CN | 108034466 | A | 5/2018 |
| CN | 108036071 | A | 5/2018 |
| CN | 108087050 | A | 5/2018 |
| CN | 207380566 | | 5/2018 |
| CN | 108103483 | A | 6/2018 |
| CN | 108179046 | A | 6/2018 |
| CN | 108254276 | A | 7/2018 |
| CN | 108311535 | A | 7/2018 |
| CN | 207583576 | | 7/2018 |
| CN | 207634064 | | 7/2018 |
| CN | 207648054 | | 7/2018 |
| CN | 207650621 | | 7/2018 |
| CN | 108371894 | A | 8/2018 |
| CN | 207777153 | | 8/2018 |
| CN | 108547601 | A | 9/2018 |
| CN | 108547766 | A | 9/2018 |
| CN | 108555826 | A | 9/2018 |
| CN | 108561098 | A | 9/2018 |
| CN | 108561750 | A | 9/2018 |
| CN | 108590617 | A | 9/2018 |
| CN | 207813495 | | 9/2018 |
| CN | 207814698 | | 9/2018 |
| CN | 207862275 | | 9/2018 |
| CN | 108687954 | A | 10/2018 |
| CN | 207935270 | | 10/2018 |
| CN | 207961582 | | 10/2018 |
| CN | 207964530 | | 10/2018 |
| CN | 108789848 | A | 11/2018 |
| CN | 108799473 | | 11/2018 |
| CN | 108868675 | A | 11/2018 |
| CN | 208086829 | | 11/2018 |
| CN | 208089263 | | 11/2018 |
| CN | 208169068 | | 11/2018 |
| CN | 108979569 | A | 12/2018 |
| CN | 109027662 | A | 12/2018 |
| CN | 109058092 | A | 12/2018 |
| CN | 208179454 | | 12/2018 |
| CN | 208179502 | | 12/2018 |
| CN | 208253147 | | 12/2018 |
| CN | 208260574 | | 12/2018 |
| CN | 109114418 | A | 1/2019 |
| CN | 109141990 | A | 1/2019 |
| CN | 208313120 | | 1/2019 |
| CN | 208330319 | | 1/2019 |
| CN | 208342730 | | 1/2019 |
| CN | 208430982 | | 1/2019 |
| CN | 208430986 | | 1/2019 |
| CN | 109404274 | A | 3/2019 |
| CN | 109429610 | A | 3/2019 |
| CN | 109491318 | A | 3/2019 |
| CN | 109515177 | A | 3/2019 |
| CN | 109526523 | A | 3/2019 |
| CN | 109534737 | A | 3/2019 |
| CN | 208564504 | | 3/2019 |
| CN | 208564516 | | 3/2019 |
| CN | 208564525 | | 3/2019 |
| CN | 208564918 | | 3/2019 |
| CN | 208576026 | | 3/2019 |
| CN | 208576042 | | 3/2019 |
| CN | 208650818 | | 3/2019 |
| CN | 208669244 | | 3/2019 |
| CN | 109555484 | A | 4/2019 |
| CN | 109682881 | A | 4/2019 |
| CN | 208730959 | | 4/2019 |
| CN | 208735264 | | 4/2019 |
| CN | 208746733 | | 4/2019 |
| CN | 208749529 | | 4/2019 |
| CN | 208750405 | | 4/2019 |
| CN | 208764658 | | 4/2019 |
| CN | 109736740 | A | 5/2019 |
| CN | 109751007 | A | 5/2019 |
| CN | 208868428 | | 5/2019 |
| CN | 208870761 | | 5/2019 |
| CN | 109869294 | A | 6/2019 |
| CN | 109882144 | A | 6/2019 |
| CN | 109882372 | A | 6/2019 |
| CN | 209012047 | | 6/2019 |
| CN | 209100025 | | 7/2019 |
| CN | 110080707 | A | 8/2019 |
| CN | 110118127 | A | 8/2019 |
| CN | 110124574 | A | 8/2019 |
| CN | 110145277 | A | 8/2019 |
| CN | 110145399 | A | 8/2019 |
| CN | 110152552 | A | 8/2019 |
| CN | 110155193 | A | 8/2019 |
| CN | 110159225 | A | 8/2019 |
| CN | 110159432 | | 8/2019 |
| CN | 110159432 | A | 8/2019 |
| CN | 110159433 | A | 8/2019 |
| CN | 110208100 | A | 9/2019 |
| CN | 110252191 | A | 9/2019 |
| CN | 110284854 | A | 9/2019 |
| CN | 110284972 | A | 9/2019 |
| CN | 209387358 | | 9/2019 |
| CN | 110374745 | A | 10/2019 |
| CN | 209534736 | | 10/2019 |
| CN | 110425105 | A | 11/2019 |
| CN | 110439779 | A | 11/2019 |
| CN | 110454285 | A | 11/2019 |
| CN | 110454352 | A | 11/2019 |
| CN | 110467298 | A | 11/2019 |
| CN | 110469312 | A | 11/2019 |
| CN | 110469314 | A | 11/2019 |
| CN | 110469405 | A | 11/2019 |
| CN | 110469654 | A | 11/2019 |
| CN | 110485982 | A | 11/2019 |
| CN | 110485983 | A | 11/2019 |
| CN | 110485984 | A | 11/2019 |
| CN | 110486249 | A | 11/2019 |
| CN | 110500255 | A | 11/2019 |
| CN | 110510771 | A | 11/2019 |
| CN | 110513097 | A | 11/2019 |
| CN | 209650738 | | 11/2019 |
| CN | 209653968 | | 11/2019 |
| CN | 209654004 | | 11/2019 |
| CN | 209654022 | | 11/2019 |
| CN | 209654128 | | 11/2019 |
| CN | 209656622 | | 11/2019 |
| CN | 107849130 | B | 12/2019 |
| CN | 108087050 | B | 12/2019 |
| CN | 110566173 | A | 12/2019 |
| CN | 110608030 | A | 12/2019 |
| CN | 110617187 | A | 12/2019 |
| CN | 110617188 | A | 12/2019 |
| CN | 110617318 | A | 12/2019 |
| CN | 209740823 | | 12/2019 |
| CN | 209780827 | | 12/2019 |
| CN | 209798631 | | 12/2019 |
| CN | 209799942 | | 12/2019 |
| CN | 209800178 | | 12/2019 |
| CN | 209855723 | | 12/2019 |
| CN | 209855742 | | 12/2019 |
| CN | 209875063 | | 12/2019 |
| CN | 110656919 | A | 1/2020 |
| CN | 107520526 | B | 2/2020 |
| CN | 110787667 | A | 2/2020 |
| CN | 110821464 | A | 2/2020 |
| CN | 110833665 | A | 2/2020 |
| CN | 110848028 | A | 2/2020 |
| CN | 210049880 | | 2/2020 |
| CN | 210049882 | | 2/2020 |

(56) References Cited

FOREIGN PATENT DOCUMENTS

| | | | |
|---|---|---|---|
| CN | 210097596 | | 2/2020 |
| CN | 210105817 | | 2/2020 |
| CN | 210105818 | | 2/2020 |
| CN | 210105993 | | 2/2020 |
| CN | 110873093 | A | 3/2020 |
| CN | 210139911 | | 3/2020 |
| CN | 110947681 | A | 4/2020 |
| CN | 111058810 | A | 4/2020 |
| CN | 111075391 | A | 4/2020 |
| CN | 210289931 | | 4/2020 |
| CN | 210289932 | | 4/2020 |
| CN | 210289933 | | 4/2020 |
| CN | 210303516 | | 4/2020 |
| CN | 211412945 | | 4/2020 |
| CN | 111089003 | A | 5/2020 |
| CN | 111151186 | A | 5/2020 |
| CN | 111167769 | A | 5/2020 |
| CN | 111169833 | A | 5/2020 |
| CN | 111173476 | A | 5/2020 |
| CN | 111185460 | A | 5/2020 |
| CN | 111185461 | A | 5/2020 |
| CN | 111188763 | A | 5/2020 |
| CN | 111206901 | A | 5/2020 |
| CN | 111206992 | A | 5/2020 |
| CN | 111206994 | A | 5/2020 |
| CN | 210449044 | | 5/2020 |
| CN | 210460875 | | 5/2020 |
| CN | 210522432 | | 5/2020 |
| CN | 210598943 | | 5/2020 |
| CN | 210598945 | | 5/2020 |
| CN | 210598946 | | 5/2020 |
| CN | 210599194 | | 5/2020 |
| CN | 210599303 | | 5/2020 |
| CN | 210600110 | | 5/2020 |
| CN | 111219326 | A | 6/2020 |
| CN | 111350595 | A | 6/2020 |
| CN | 210660319 | | 6/2020 |
| CN | 210714569 | | 6/2020 |
| CN | 210769168 | | 6/2020 |
| CN | 210769169 | | 6/2020 |
| CN | 210769170 | | 6/2020 |
| CN | 210770133 | | 6/2020 |
| CN | 210825844 | | 6/2020 |
| CN | 210888904 | | 6/2020 |
| CN | 210888905 | | 6/2020 |
| CN | 210889242 | | 6/2020 |
| CN | 111397474 | A | 7/2020 |
| CN | 111412064 | A | 7/2020 |
| CN | 111441923 | A | 7/2020 |
| CN | 111441925 | A | 7/2020 |
| CN | 111503517 | A | 8/2020 |
| CN | 111515898 | A | 8/2020 |
| CN | 111594059 | A | 8/2020 |
| CN | 111594062 | A | 8/2020 |
| CN | 111594144 | A | 8/2020 |
| CN | 211201919 | | 8/2020 |
| CN | 211201920 | | 8/2020 |
| CN | 211202218 | | 8/2020 |
| CN | 111608965 | A | 9/2020 |
| CN | 111664087 | A | 9/2020 |
| CN | 111677476 | A | 9/2020 |
| CN | 111677647 | A | 9/2020 |
| CN | 111692064 | A | 9/2020 |
| CN | 111692065 | A | 9/2020 |
| CN | 211384571 | | 9/2020 |
| CN | 211397553 | | 9/2020 |
| CN | 211397677 | | 9/2020 |
| CN | 211500955 | | 9/2020 |
| CN | 211524765 | | 9/2020 |
| DE | 4004854 | | 8/1991 |
| DE | 4241614 | | 6/1994 |
| DE | 102009022859 | | 12/2010 |
| DE | 102012018825 | | 3/2014 |
| DE | 102013111655 | | 12/2014 |
| DE | 102015103872 | | 10/2015 |
| DE | 102013114335 | | 12/2020 |
| EP | 0835983 | | 4/1998 |
| EP | 1378683 | | 1/2004 |
| EP | 2143916 | | 1/2010 |
| EP | 2613023 | | 7/2013 |
| EP | 3095989 | | 11/2016 |
| EP | 3211766 | | 8/2017 |
| EP | 3049642 | | 4/2018 |
| EP | 3354866 | | 8/2018 |
| EP | 3075946 | | 5/2019 |
| FR | 2795774 | | 6/1999 |
| GB | 474072 | | 10/1937 |
| GB | 1438172 | | 6/1976 |
| GB | 2737321 | | 9/2013 |
| JP | S57135212 | | 2/1984 |
| KR | 20020026398 | | 4/2002 |
| RU | 13562 | | 4/2000 |
| WO | 1993020328 | | 10/1993 |
| WO | 2006025886 | | 3/2006 |
| WO | 2009023042 | | 2/2009 |
| WO | 20110133821 | | 10/2011 |
| WO | 2012139380 | | 10/2012 |
| WO | 2013158822 | | 10/2013 |
| WO | PCT/CN2012/074945 | | 11/2013 |
| WO | 2013185399 | | 12/2013 |
| WO | 2015158020 | | 10/2015 |
| WO | 2016/014476 | | 1/2016 |
| WO | 2016033983 | | 3/2016 |
| WO | 2016078181 | | 5/2016 |
| WO | 2016101374 | | 6/2016 |
| WO | 2016112590 | | 7/2016 |
| WO | 2017123656 | A | 7/2017 |
| WO | 2017146279 | | 8/2017 |
| WO | 2017213848 | | 12/2017 |
| WO | 2018031029 | | 2/2018 |
| WO | 2018038710 | | 3/2018 |
| WO | 2018044293 | | 3/2018 |
| WO | 2018044307 | | 3/2018 |
| WO | 2018071738 | | 4/2018 |
| WO | 2018101909 | | 6/2018 |
| WO | 2018101912 | | 6/2018 |
| WO | 2018106210 | | 6/2018 |
| WO | 2018106225 | | 6/2018 |
| WO | 2018106252 | | 6/2018 |
| WO | 2018/132106 | | 7/2018 |
| WO | 2018156131 | | 8/2018 |
| WO | 2018075034 | | 10/2018 |
| WO | 2018187346 | | 10/2018 |
| WO | 2018031031 | | 2/2019 |
| WO | 2019045691 | | 3/2019 |
| WO | 2019046680 | | 3/2019 |
| WO | 2019060922 | | 3/2019 |
| WO | 2019117862 | | 6/2019 |
| WO | 2019126742 | | 6/2019 |
| WO | 2019147601 | | 8/2019 |
| WO | 2019169366 | | 9/2019 |
| WO | 2019195651 | | 10/2019 |
| WO | 2019200510 | | 10/2019 |
| WO | 2019210417 | | 11/2019 |
| WO | 2020018068 | | 1/2020 |
| WO | 2020046866 | | 3/2020 |
| WO | 2020072076 | | 4/2020 |
| WO | 2020076569 | | 4/2020 |
| WO | 2020097060 | | 5/2020 |
| WO | 2020104088 | | 5/2020 |
| WO | WO-2020097060 | A2 * | 5/2020 ..... F04B 23/04 |
| WO | 2020131085 | | 6/2020 |
| WO | 2020211083 | | 10/2020 |
| WO | 2020211086 | | 10/2020 |
| WO | 2021/038604 | | 3/2021 |
| WO | 2021038604 | | 3/2021 |
| WO | 2021041783 | | 3/2021 |

OTHER PUBLICATIONS

American Petroleum Institute. API 674: Positive Displacement Pumps-Reciprocating. 3rd ed. pp. 1-108, Dec. 2010, API Publishing Services, Washington DC 2010.*

(56) References Cited

OTHER PUBLICATIONS

American Petroleum Institute API 674: Positive Displacement Pumps-REciprocating. 3rd ed. pp. 1-108, Dec. 2010, API Publishing Services, Washington DC 2010. (Year: 2010).*
ISM, What is Cracking Pressure, 2019.
Swagelok, The right valve for controlling flow direction? Check, 2016.
Technology.org, Check valves how do they work and what are the main type, 2018.
ResearchGate, Answer by Byron Woolridge, found at https://www.researchgate.net/post/How_can_we_improve_the_efficiency_of_the_gas_turbine_cycles, Jan. 1, 2013.
Filipović, Ivan, Preliminary Selection of Basic Parameters of Different Torsional Vibration Dampers Intended for use in Medium-Speed Diesel Engines, Transactions of Famena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oiffield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose_com. Accessed: Nov. 10, 2019. http://www.4starhose.com/product/frac_tank_hose_frac.aspx.
PLOS ONE, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-fracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, Jul. 15, 2017, https://ifsolutions.com/why-modular/.
Cameron, A Schlumberger Company, Frac Manifold Systems, 2016.
ZSi-Foster, Energy | Solar | Fracking | Oil and Gas, https://www.zsi-foster.com/energy-solar-fracking-oil-and-gas.html.
JBG Enterprises, Inc., WS-Series Blowout Prevention Safety Coupling—Quick Release Couplings, http://www.jgbhose.com/products/WS-Series-Blowout-Prevention-Safety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., .Electric Power Generation Potential Based on Waste Heat and Geothermal Resources in South Africa, pangea.stanford.edu (Feb. 11, 2019).
Department of Energy, United States of America, The Water-Energy Nexus: Challenges and Opportunities burenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.
Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia, Nov. 3, 2012.
Blago Minovski, Coupled Simulations of Cooling and Engine Systems for Unsteady Analysis of the Benefits of Thermal Engine Encapsulation, Department of Applied Mechanics, Chalmers University of Technology G¨oteborg, Sweden 2015.
J. Porteiro et al., Feasibility of a new domestic CHP trigeneration with heat pump: II. Availability analysis. Design and development, Applied Thermal Engineering 24 (2004) 1421-1429.
Europump and Hydrualic Institute, Variable Speed Pumping: A Guide to Successful Applications, Elsevier Ltd, 2004.
Capstone Turbine Corporation, Capstone Receives Three Megawatt Order from Large Independent Oil & Gas Company in Eagle Ford Shale Play, Dec. 7, 2010.
Wikipedia, Westinghouse Combustion Turbine Systems Division, https://en.wikipedia.org/wiki/Westinghouse_Combustion_Turbine_Systems_Division, circa 1960.
Wikipedia,Union Pacific GTELs, https://en.wikipedia.orgiwiki/Union_Pacific_GTELs, circa 1950.
HCI JET Frac, Screenshots from YouTube, Dec. 11, 2010. https://www.youtube.com/watch?v=6HjXkdbFaFQ.
AFD Petroleum LTD., Automated Hot Zone, Frac Refueling System, Dec. 2018.
Eygun, Christiane, et al., URTeC: 2687987, Mitigating Shale Gas Developments Carbon Footprint: Evaluating and Implementing Solutions in Argentina, Copyright 2017, Unconventional Resources Technology Conference.
Walzel, Brian, Hart Energy, Oil, Gas Industry Discovers Innovative Solutions to Environmental Concerns, Dec. 10, 2018.
FRAC Shack, Bi-Fuel FracFueller brochure, 2011.
ettigrew, Dana, et al., High Pressure Multi-Stage Centrifugal Pump for 10,000 psi Frac Pump—HPHPs Frac Pump, Copyright 2013, Society of Petroleum Engineers, SPE 166191.

(56) References Cited

OTHER PUBLICATIONS

Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.
Wallace, E.M., Associated Shale Gas: From Flares to Rig Power, Copyright 2015, Society of Petroleum Engineers, SPE-173491-MS.
Williams, C.W. (Gulf Oil Corp. Odessa Texas), The Use of Gas-turbine Engines in an Automated High-Pressure Water-Injection Stations; American Petroleum Institute; API-63-144 (Jan. 1, 1963).
Neal, J.C. (Gulf Oil Corp. Odessa Texas), Gas Turbine Driven Centrifugal Pumps for High Pressure Water Injection; American Institute of Mining, Metallurgical and Petroleum Engineers, Inc.; SPE-1888 (1967).
Porter, John A. (Solar Division International Harvester Co.), Modem Industrial Gas Turbines for the Oil Field; American Petroleum Institute; Drilling and Production Practice; API-67-243 (Jan. 1, 1967).
Cooper et al., Jet Frac Porta-Skid—A New Concept in Oil Field Service Pump Equipments[sic]; Halliburton Services; SPE-2706 (1969).
Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).
Kas'yanov et al., Application of gas-turbine engines in pumping units complexes of hydraulic fracturing of oil and gas reservoirs; Exposition Oil & Gas; (Oct. 2012) (published in Russian).
American Petroleum Institute. API 674: Positive Displacement Pumps—Reciprocating. 3rd ed. Washington, DC: API Publishing Services, 2010.
American Petroleum Institute. API 616: Gas Turbines for the Petroleum, Chemical, and Gas Industry Services. 5th ed. Nashington, DC: API Publishing Services, 2011.
Karassik, Igor, Joseph Messina, Paul Cooper, and Charles Heald. Pump Handbook. 4th ed. New York: McGraw-Hill Education, 2008.
Weir SPM. Weir SPM General Catalog: Well Service Pumps, Flow Control Products, Manifold Trailers, Safety Products, Post Sale Services. Ft. Worth, TX: Weir Oil & Gas. May 28, 2016. https://www.pumpfundamentals.com/pumpdatabase2/weir-spm-general.pdf.
The Weir Group, Inc. Weir SPM Pump Product Catalog. Ft. Worth, TX: S.P.M. Flow Control, Inc. Oct. 30, 2017. https://manage.global.weir/assets/files/product%20brochures/SPM_2P140706_Pump_Product_Catalogue_View.pdf.
Shandong Saigao Group Corporation. Q4 (5W115) Quintuplex Plunger Pump. Jinan City, Shandong Province, China: Saigao Oct. 20, 2014. https://www.saigaogroup.com/product/q400-5w115-quintuplex-plunger-pump.html.
Marine Turbine. Turbine Powered Frac Units. Franklin, Louisiana: Marine Turbine Technologies, 2020.
Rotating Right. Quintuplex Power Pump Model Q700. Edmonton, Alberta, Canada: Weatherford International Ltd. https://www.rotatingright.com/pdf/weatherford/RR%2026-Weatherford%20Model%20Q700pdf, 2021.
CanDyne Pump Services, Inc. Weatherford Q700 Pump. Calgary, Alberta, Canada: CanDyne Pump Services. Aug. 15, 2015. http://candyne.com/wp-content/uploads/2014/10/181905-94921.q700-quintuplex-pump.pdf.
Arop, Julius Bankong. Geomechanical review of hydraulic fracturing technology. Thesis (M. Eng.). Cambridge, MA: Massachusetts Institute of Technology, Dept, of Civil and Environmental Engineering. Oct. 29, 2013. https://dspace.mit.edu/handle/1721.1/82176.
AFGlobal Corporation, Durastim Hydraulic Fracturing Pump, A Revolutionary Design for Continuous Duty Hydraulic Fracturing, 2018.
SPM® QEM 5000 E-Frac Pump Specification Sheet, Weir Group (2019) ("Weir 5000").
Green Field Energy Services Natural Gas Driven Turbine Frac Pumps HHP Summit Presentation, Yumpu (Sep. 2012), https://www.yumpu.com/en/document/read/49685291/turbine-frac-pump-assembly-hhp ("Green Field").
Dowell B908 "Turbo-Jet" Operator's Manual.
Jereh Debut's Super-power Turbine Fracturing Pump, Leading the Industrial Revolution, Jereh Oilfield Services Group (Mar. 19, 2014), https://www.prnewswire.com/news-releases/jereh-debuts-super-power-turbine-fracturing-pump-leading-the-industrial-revolution-250992111.html.
Jereh Apollo 4500 Turbine Frac Pumper Finishes Successful Field Operation in China, Jereh Group (Feb. 13, 2015), as available on Apr. 20, 2015, https://web.archive.org/web/20150420220625/https://www. prnewswire.com/news-releases/jereh-apollo-4500-turbine-frac-pumper-finishes-successful-field-operation-in-china-300035829.html.
35% Economy Increase, Dual-fuel System Highlighting Jereh Apollo Frac Pumper, Jereh Group (Apr. 13, 2015), https://www.jereh.com/en/news/press-release/news-detail-7345.htm.
Hydraulic Fracturing: Gas turbine proves successful in shale gasfield operations, Vericor (2017), https://www.vericor.com/wp-content/uploads/2020/02/7.-Fracing-4500hp-Pump-China-En.pdf ("Vericor Case Study").
Jereh Apollo Turbine Fracturing Pumper Featured on China Central Television, Jereh Group (Mar. 9, 2018), https://www.jereh.com/en/news/press-release/news-detail-7267.htm.
Jereh Unveiled New Electric Fracturing Solution at OTC 2019, Jereh Group (May 7, 2019), as available on May 28, 2019, https://web.archive.org/web/20190528183906/https://www.pmewswire .com/news-releases/jereh-unveiled-new-electric-fracturing-solution-at-otc-2019-300845028.html.
Jereh Group, Jereh Fracturing Unit, Fracturing Spread, YouTube (Mar. 30, 2015), https://www.youtube.com/watch?v=PIkDbU5dE0o.
Transcript of Jereh Group, Jereh Fracturing Unit, Fracturing Spread, YouTube (Mar. 30, 2015).
Jereh Group, Jereh Fracturing Equipment. YouTube (Jun. 8, 2015), https://www.youtube.com/watch?v=m0vMiq84P4Q.
Transcript of Jereh Group, Jereh Fracturing Equipment, YouTube (Jun. 8, 2015), https://www.youtube.com/watch?v=m0vMiq84P4Q.
Ferdinand P. Beer et al., Mechanics of Materials (6th ed. 2012).
Weir Oil & Gas Introduces Industry's First Continuous Duty 5000-Horsepower Pump, Weir Group (Jul. 25, 2019), https://www.global. weir/newsroom/news-articles/weir-oil-and-gas-introduces-industrys-first-continuous-duty-5000-horsepower-pump/.
2012 High Horsepower Summit Agenda, Natural Gas for High Horsepower Applications (Sept. 5, 2012).
Review of HHP Summit 2012, Gladstein, Neandross & Associates https://www.gladstein.org/gna-conferences/high-horsepower-summit-2012/.
Green Field Energy Services Deploys Third New Hydraulic Fracturing System, Green Field Energy Services, Inc. (Jul. 11, 2012), https://www.prnewswire.com/news-releases/green-field-energy-services-deploys-third-new-hydraulic-fracturing-spread-162113425.
Karen Boman, Turbine Technology Powers Green Field Multi-Fuel Frack Pump, Rigzone (Mar. 7, 2015), as available an Mar. 14, 2015, https://web.archive.org/web/20150314203227/https://www.rigzone.co m/news/oil-gas/a/124883/Turbine_Technology_Powers_Green_Field_ MultiFuel_Frack_Pump.
"Turbine Frac Units," WMD Squared (2012), https://wmdsquared.com/work/gfes-turbine-frac-units/.
Leslie Turj, Green Field asset sale called 'largest disposition industry has seen,' The INDsider Media (Mar. 19, 2014), http://theind.com/ article-16497-green-field-asset-sale-called-%E2%80%98largest-disposition-industry-has-seen%60.html.
Special-Purpose Couplings for Petroleum, Chemical, and Gas Industry Services, API Standard 671 (4th Edition) (2010.
The Application of Flexible Couplings for Turbomachinery, Jon R.Mancuso et al., Proceedings of the Eighteenthturbomachinery Symposium (1989).
Pump Control With Variable Frequency Drives, Kevin Tory, Pumps & Systems: Advances in Motors and Drives, Reprint from Jun. 2008.

(56) References Cited

OTHER PUBLICATIONS

Fracture Design and Stimulation, Mike Eberhard, P.E., Wellconstruction & Operations Technical Workshop Insupport of the EPA Hydraulic Fracturing Study, Mar. 10-11, 2011.
General Purpose vs. Special Purpose Couplings, Jon Mancuso, Proceedings of the Twenty-Third Turbomachinerysymposium (1994).
Overview of Industry Guidance/Best Practices on Hydraulic Fracturing (HF), American Petroleum Institute, © 2012.
API Member Companies, American Petroleum Institute, WaybackMachine Capture, https://web.archive.org/web/20130424080625/http://api.org/globalitems/globalheaderpages/membership/api-member-companies, accessed Jan. 4, 2021.
API's Global Industry Services, American Petroleum Institute, © Aug. 2020.
About API, American Petroleum Institute, https://www.api.org /about, accessed Dec. 30, 2021.
About API, American Petroleum Institute, WaybackMachine Capture, https://web archive.org/web/20110422104346 /http://api.org/aboutapi/, captured Apr. 22, 2011.
Publications, American Petroleum Institute, WaybackMachine Capture, https://web.archive.org/web/20110427043936 /http://www.api.org:80/Publications/, captured Apr. 27, 2011.
Procedures for Standards Development, American Petroleum Institute, Third Edition (2006).
WorldCat Library Collections Database Records for API Standard 671 and API Standard 674, https://www.worldcat.org/title/positive-displacement-pumps-reciprocating/oclc/ 858692269&referer=brief_results, accessed Dec. 30, 2021; and https://www.worldcat.org/title/special-purpose-couplings-for-petroleum-chemical-and-gas-industry-services/oclc/871254217&referer=brief_results, accessed Dec. 22, 2021.
2011 Publications and Services, American Petroleum Institute (2011).
Standards, American Petroleum Institute, WaybackMachine Capture, https://web.archive.org/web/20110207195046/http:/www.api.org/Standards/, captured Feb. 7, 2011; and https://web.archive.org/web/20110204112554/http://global.ihs.com/?RID=API1, captured Feb. 4, 2011.
IHS Markit Standards Store, https://global.ihs.com/doc_ detail.cfm?document_name=API%20STD%20674&item_s_key=00010672#doc-detail-history-anchor, accessed Dec. 30, 2021; and https://global.ihs.com/doc_detail.cfm?&input_doc _number=671 &input_doc_title=&document_name=API%20STD%20671&item_s_key=00010669&item_key_date=890331&origin=DSSC, accessed Dec. 30, 2021.
"Honghua developing new-generation shale-drilling rig, plans testing of frac pump"; Katherine Scott; Drilling Contractor May 23, 2013; accessed at https://www.drillingcontractor.org/honghua-developing-new-generation-shale-drilling-rig-plans-testing-of-frac-pump-23278.
De Gevigney et al., "Analysis of no-load dependent power losses in a planetary gear train by using thermal network method", International Gear Conference 2014: 26th-28th, Aug. 2014, Lyon, pp. 615-624.
International Search Report and Written Opinion for PCT/US2022/030647, dated Oct. 7, 2022.
Dziubak, Tadeusz, "Experimental Studies of Dust Suction Irregularity from Multi-Cyclone Dust Collector of Two-Stage Air Filter", Energies 2021, 14, 3577, 28 pages.
Rigmaster Machinery Ltd., Model: 2000 RMP-6-PLEX, brochure, downloaded at https://www.rigmastermachinery.com/_files/ugd/431e62_eaecd77c9fe54af8b13d08396072da67.pdf.
Karassik, Igor, Joseph Messina, Paul Cooper, and Charles Heald, Pump Handbook. 4th ed., pp. 1-311, 2008, McGraw-Hill Education, New York.†
American Petroleum Institute. API 674: Positive Displacement Pumps—Reciprocating. 3rd ed., pp. 1-108, Dec. 2010, API Publishing Services, Washington, DC.†
American Petroleum Institute. API 616: Gas Turbines for the Petroleum, Chemical, and Gas Industry Services. 5th ed., Jan. 2011, API Publishing Services, Washington, DC.†

* cited by examiner
† cited by third party

METHODS AND SYSTEMS FOR OPERATING A FLEET OF PUMPS

CROSS REFERENCE TO RELATED APPLICATIONS

This application is a continuation of U.S. Non-Provisional application Ser. No. 17/387,477, filed Jul. 28, 2021, titled "METHODS AND SYSTEMS FOR OPERATING A FLEET OF PUMPS," which is a continuation of U.S. Non-Provisional application Ser. No. 17/118,790, filed Dec. 11, 2020, titled "METHODS AND SYSTEMS FOR OPERATING A FLEET OF PUMPS," which is a continuation of U.S. Non-Provisional application Ser. No. 17/022,972, filed Sep. 16, 2020, titled "METHODS AND SYSTEMS FOR OPERATING A FLEET OF PUMPS," now U.S. Pat. No. 10,907,459, issued Feb. 2, 2021, which is continuation of U.S. Non-Provisional application Ser. No. 16/946,082, filed Jun. 5, 2020, titled "METHODS AND SYSTEMS FOR OPERATING A FLEET OF PUMPS," now U.S. Pat. No. 10,815,764, issued Oct. 27, 2020, which claims the benefit of and priority to U.S. Provisional Application No. 62/899,951, filed Sep. 13, 2019, titled "METHODS AND SYSTEMS FOR OPERATING A FLEET OF PUMPS," the entire disclosures of which are incorporated herein by reference.

BACKGROUND OF THE DISCLOSURE

This disclosure relates to operating a fleet of pumps for hydraulic fracturing and, in particular, to systems and methods for operating a directly driven turbine fracturing pump system for hydraulic fracturing application.

Traditional Diesel fracturing pumping fleets have a large footprint and often need additional auxiliary equipment to achieve the horsepower required for hydraulic fracturing. FIG. 1 shows a typical pad layout for a fracturing pump system 100 including fracturing or frac pumps 101*a* through 101*i*, with the pumps all being driven by a diesel powered engine and operatively connected to a manifold 105 that is operatively connected to a wellhead 110. By way of an example, in order to achieve a maximum rated horsepower of 24,000 HP, a quantity of eight (8) 3000 HP pumping units (101*a*-101*h* or frac pump 1 to frac pump 8) may be required as well as an additional one (1) spare unit (101*i* or frac pump 9) that may be readily brought online if one of the operating units is brought off line for either maintenance purposes or for immediate repairs. The numbers above are provided by way of an example and do not include frictional and other losses from prime mover to the pumps.

The layout as indicated in FIG. 1 requires a large footprint of service equipment, including hoses, connections, assemblies and other related equipment that may be potential employee hazards. Additionally, the spare unit, such as the one indicated by 101*i* in FIG. 1, may need to be kept on standby so that additional fuel may be utilized, thereby adding further equipment requirements to the footprint that may be yet further potential employee hazards.

Accordingly, Applicant has recognized that a need exists for more efficient ways of managing power requirement for a hydraulic fracturing fleet while minimizing equipment layout foot print. The present disclosure addresses these and other related and unrelated problems in the art.

SUMMARY OF THE DISCLOSURE

According to one embodiment of the disclosure, a method of operating a plurality of pump units associated with a high-pressure, high-power hydraulic fracturing assembly is provided. Each of the pump units may include a turbine engine, a driveshaft, a gearbox connected to the turbine engine and driveshaft for driving the driveshaft, and a pump connected to the driveshaft. The method may include receiving a demand hydraulic horse power (HHP) signal for operation of the hydraulic fracturing assembly. Based at least in part on the demand HHP signal, the method may include operating all available pump units of the plurality of pump units at a first output power to achieve the demand HHP. The method may include receiving a loss of power signal for at least one pump unit of the plurality of pump units during operation of the plurality of pump units, and after receiving the loss of power signal, designating the at least one pump unit as a reduced power pump unit (RPPU) and the remaining pump units as operating pump units (OPU). The method may further include operating at least one of the OPUs at a second output power to meet the demand HHP signal for operation of the hydraulic fracturing assembly. The first output power may be in the range of approximately 70% to 100% of a maximum continuous power (MCP) level of the plurality of pump units, the second output power may be greater than the first output power and may be in the range of approximately 70% of the MCP level to approximately a maximum intermittent power (MIP) level of the plurality of pump units.

According to another embodiment of the disclosure, a system is disclosed to control operation of a plurality of pump units associated with a hydraulic fracturing assembly. Each of the pump units may include a turbine engine connected to a gearbox for driving a driveshaft, and a pump connected to the drive shaft. The system includes a controller in communication with the plurality of pump units. The controller may include one or more processors and memory having computer-readable instructions stored therein and may be operable by the processor to receive a demand hydraulic horse power (HHP) signal for the hydraulic fracturing assembly. Based at least in part on the demand HHP signal, the controller may operate all available pump units of the plurality of pump units at a first output power to achieve the demand HHP, and may receive a loss of power signal from at least one pump unit of the plurality of pump units. After receiving the loss of power signal, the controller may designate the at least one pump unit as a reduced power pump unit (RPPU), and designate the remaining pump units as operating pump units (OPU). The controller may further operate one or more of the OPUs at a second output power to meet the demand HHP signal of the hydraulic fracturing system. The first output power may be in the range of approximately 70% to 100% of a maximum continuous power (MCP) level of the plurality of pump units. The second output power may be greater than the first output power and may be in the range of approximately 70% of MCP level to approximately a maximum intermittent power (MIP) level of the plurality of pump units.

Those skilled in the art will appreciate the benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE FIGURES

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Generally, this disclosure is directed to methods and systems for controlling a fleet of DDT pumping units 11 (FIG. 3) as part of a high-pressure, high-power, fluid pumping system 400 (FIG. 2) for use in hydraulic fracturing operations. The systems and method of the present disclosure, for example, help reduce or eliminate the need for a spare pumping unit to be associated with the fluid pumping system 400, among other features.

Figure 1:
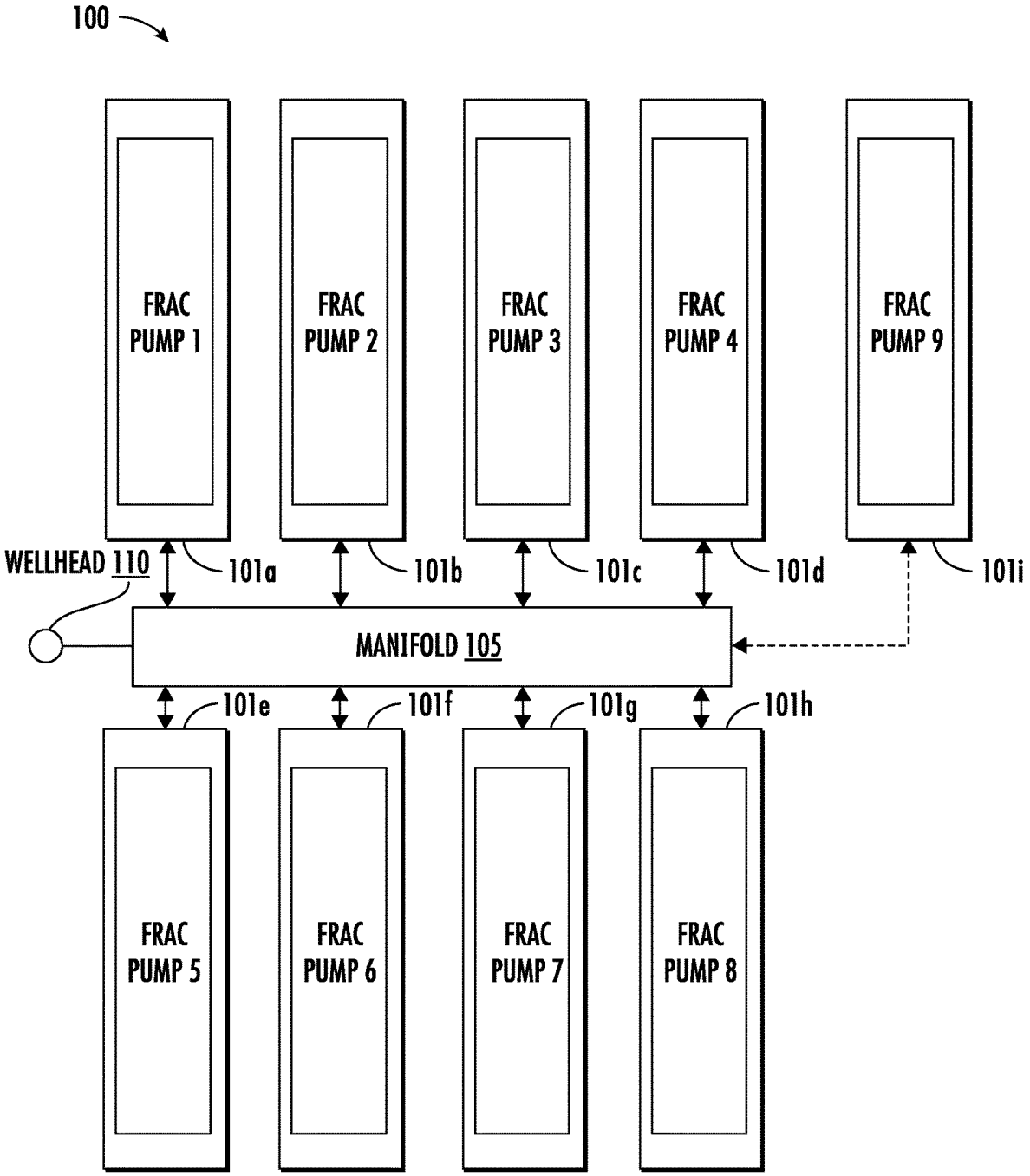
FIG. 1 PRIOR ART
FIG. 1 is a schematic diagram of a typical prior art fracturing pad layout for a hydraulic fracturing application according to the prior art.
Figure 2:
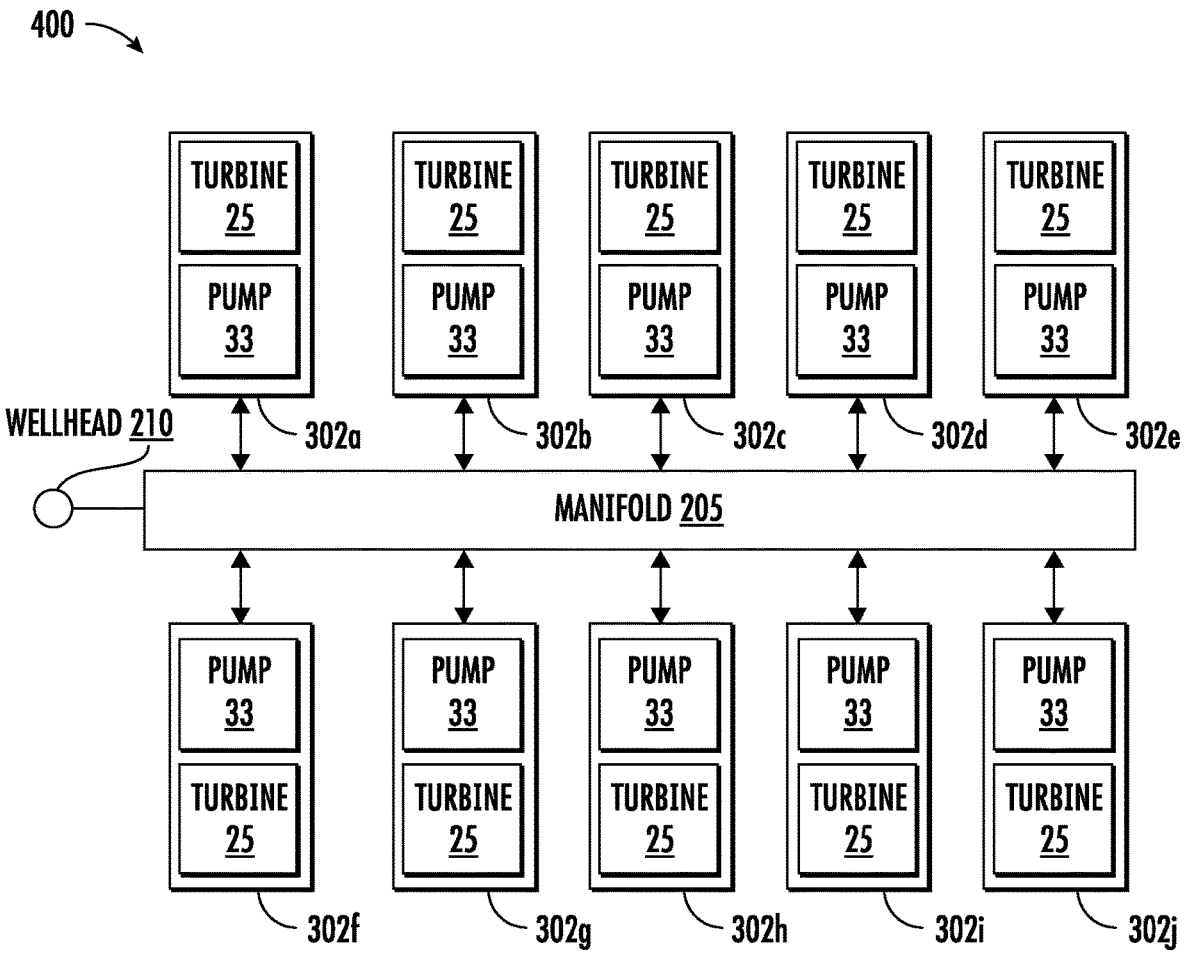
FIG. 2 is a schematic diagram of a layout of a fluid pumping system according to an embodiment of the disclosure.
Figure 3:
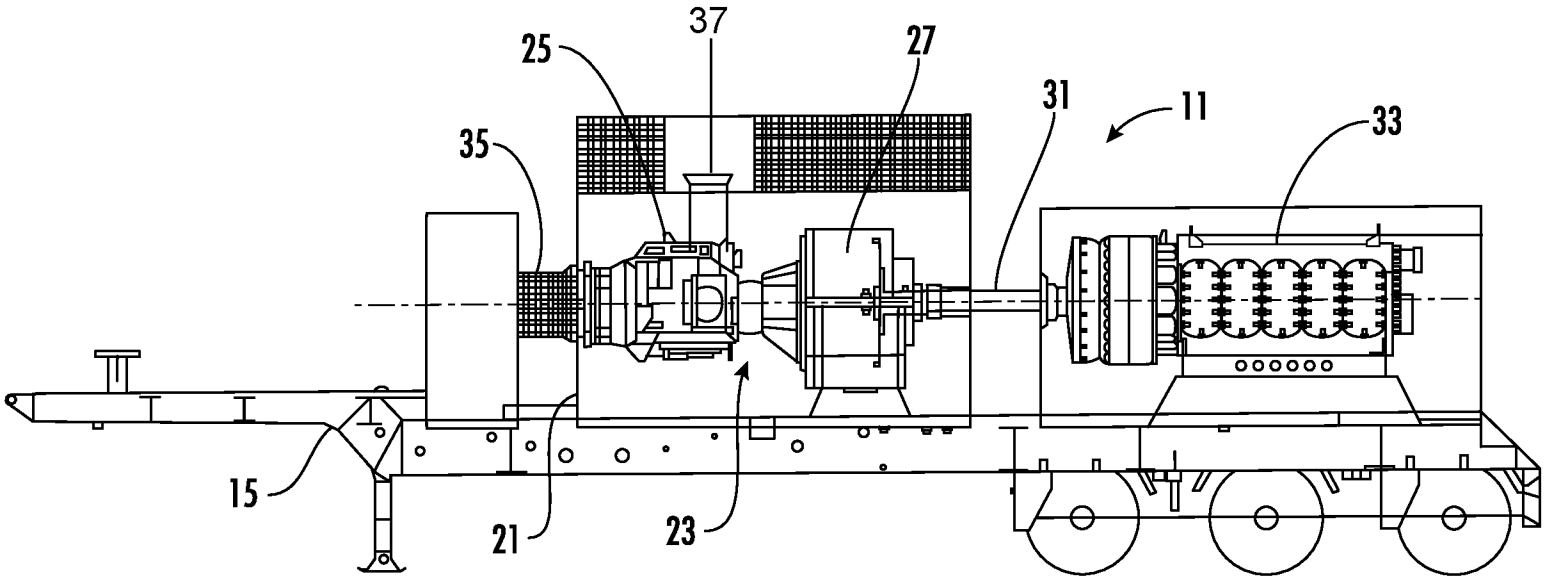
FIG. 3 is a schematic diagram of a directly driven turbine (DDT) pumping unit used in the fluid pumping system of FIG. 2 according an embodiment of the disclosure.
Figure 5:
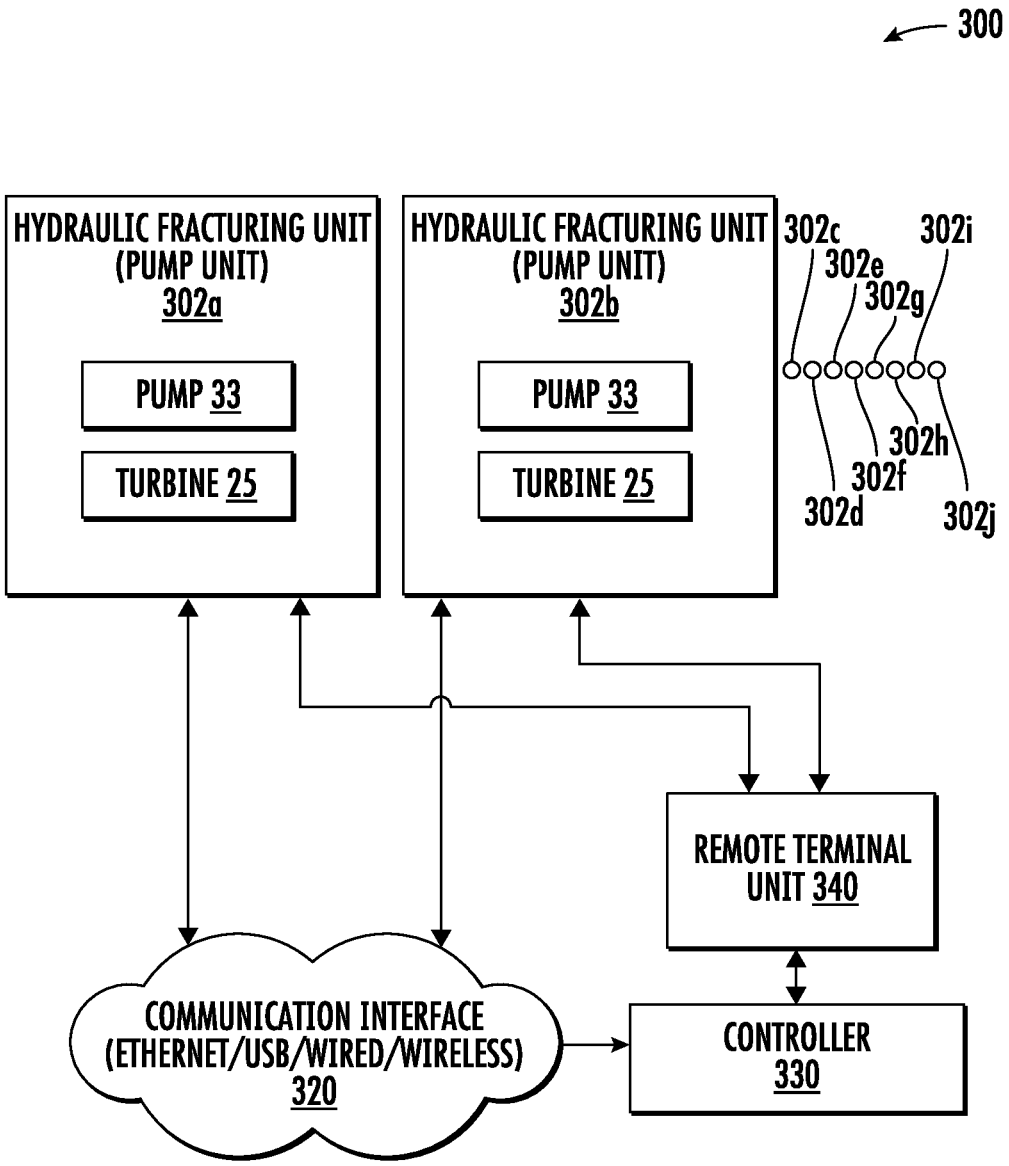
FIG. 5 is a schematic diagram of a system for controlling the fluid pumping system of FIG. 2.

FIG. 3 illustrates a schematic view of a pumping unit 11 for use in a high-pressure, high power, fluid pumping system 400 (FIG. 2) for use in hydraulic fracturing operations according to one embodiment of the disclosure. FIG. 5 shows a pad layout of the pumping units 11 (indicated as 302*a* thru 302*j*) with the pumping units all operatively connected to a manifold 205 that is operatively connected to a wellhead 210. By way of an example, the system 400 is a hydraulic fracturing application that may be sized to deliver a total Hydraulic Horse Power (HHP) of 41,000 to the wellhead 210 as will be understood by those skilled in the art. In the illustrated embodiment, a quantity of ten pumping units 11 are used, but the system 400 may be otherwise configured to use more or less than then pumping units without departing from the disclosure. As shown in FIG. 3, each of the pumping units 11 are mounted on a trailer 15 for transport and positioning at the jobsite. Each pumping unit 11 includes an enclosure 21 that houses a direct drive unit (DDU) 23 including a gas turbine engine (GTE) 25 operatively connected to a gearbox 27. The pumping unit 11 has a driveshaft 31 operatively connected to the gearbox 27. The pumping unit 11, for example, may include a high-pressure, high-power, reciprocating positive displacement pump 33 that is operatively connected to the DDU 23 via the driveshaft 31. In one embodiment, the pumping unit 11 is mounted on the trailer 15 adjacent the DDU 23. The trailer 15 includes other associated components such as a turbine exhaust duct 35 operatively connected to the gas turbine engine 25, air intake duct 37 operatively connected to the gas turbine, and other associated equipment hoses, connections, etc. to facilitate operation of the fluid pumping unit 11. In one embodiment, the gas turbine engine 25 may operate on primary fuel, which may include gas fuels, such as, for example, compressed natural gas (CNG), natural gas, field gas or pipeline gas, and on secondary fuel, which may include liquid fuels, such as, for example, #2 Diesel or Bio-fuels.

In an embodiment, the gas turbine engine 25 may be a dual shaft, dual fuel turbine with a rated shaft horsepower (SHP) of 5100 at standard conditions, or other suitable gas turbine. The gearbox 27 may be a reduction helical gearbox that has a constant running power rating of 5500 SHP and intermittent power output of 5850 SHP, or other suitable gearbox. The driveshaft 31 may be a 390 Series, GWB Model 390.80 driveshaft available from Dana Corporation, or other suitable driveshaft. In one example, the pump 33 may be a high-pressure, high-power, reciprocating positive displacement pump rated at 5000 HP, but the pump may be rated to an elevated horsepower above the gas turbine engine 25, e.g., 7000 HP, or may be otherwise sized without departing from the disclosure.

In one embodiment, for example, the desired HHP of the fluid pumping system 400 may be 41,000 HHP and the fluid pumping system 400 having ten pump units 302*a* thru 302*j* that deliver the 41,000 HHP by each operating at an operating power below a Maximum Continuous Power (MCP) rating of each the pump unit. The Maximum Continuous Power (MCP) level of the pump corresponds to the maximum power at which the individual pump units 302*a* thru 302*j* may sustain continuous operation without any performance or reliability penalties. In one example, the ten pump units 302*a* thru 302*j* may operate at approximately 80% MCP to deliver the 41,000 HHP required for the fluid pumping system 400. The Maximum Intermittent Power (MIP) level of a pump unit 302*a* thru 302*j* is an elevated operating output level that the pump unit may operate intermittently throughout its operating life without excessive damage to the pump unit. The operation of a pump unit 302*a* thru 302*j* at or above the MIP power level may incur penalties associated with pump unit life cycle estimates and other warranties. The MIP power level for a DDT pump unit 302*a* thru 302*j* may be attained by over-firing the turbine engine 25 associated with the pump unit 302*a* thru 302*j* or by other means of operation. The MIP power level of the pump units 302*a* thru 302*j* is typically an amount above the MCP level and may typically range from 101% of rated MCP to 110% of rated MCP. In an embodiment of the disclosure, the MIP level may be set at 107% of rated power. In other embodiments, the MIP level may be greater than 110% of rated MCP without departing from the disclosure.

Figure 4:
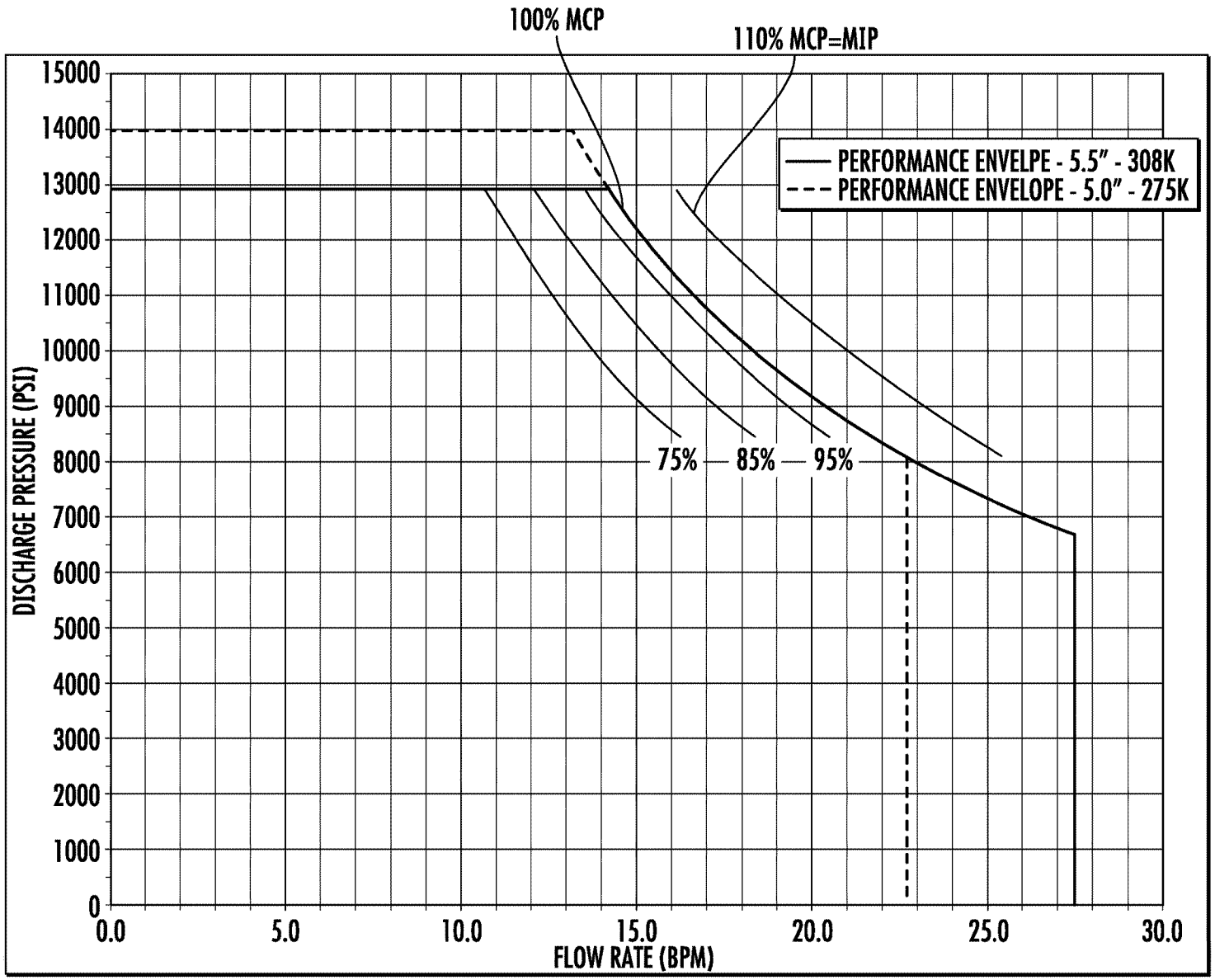
FIG. 4 is a pump operating curve for a DDT pumping unit of FIG. 3.

FIG. 4 illustrates a graph of a discharge pressure vs. flow rate curve for exemplary pump units 302*a* thru 302*j* of the present disclosure. As indicated in FIG. 4, the pump units 302*a*-302*j* (as an example, 5000 HP pump units are shown) may operate in typical operating range of approximately 75% to 95% of MCP to deliver the required HHP of the fluid pumping system 400 for a particular well site. The corresponding percentage of MCP of the pump units 302*a*-302*j* is indicated by the 75%, 85%, and 95% lines that are parallel to the 100% MCP line. Any operation of the pump unit 302*a* thru 302*j* beyond the 100% MCP curve should be an intermittent occurrence to avoid damage to the pump unit. In one example, the MIP is indicated at 110% MCP, but the MIP may be other percentages to the right of the 100% MCP line without departing from the disclosure. One or more of these parallel curves below the 100% MCP line may demonstrate the percentage of the maximum pump power output that may be required to maintain the HHP of the fluid pumping system 400. The two lines, i.e., solid line (5.5") and dashed line (5.0") respectively correspond to the diameter of a plunger being used in a reciprocating pump. As will be understood by those skilled in the art, some pump manufacturer may make pumps with plunger/packing assemblies that vary from 4.5" to 5.5", for example. When the pumps run at equal power outputs, there is a change or difference in a rod load (force) on the plunger due to differences in an elevated surface area, e.g., which is why one may have 308,000 lbs/f for a 5.5" plunger as compared to 275,000 lbs for a 5" plunger. A pump, in these situations for example, only may handle a certain amount of total HHP with either an elevated pressure (which is achieved with a larger plunger) and a compromised rate, or vice versa, as will be understood by those skilled in the art. In some embodiments, the 5" plunger may be desirable, and the different solid black lines are indicating performance at certain HHP outputs. As discussed below, upon a loss of power situation of one of the pumps units 302*a* thru 302*j*, the other pump units may operate above the desired/normal pump power output to maintain the needed HHP of the fluid pumping system 400.

FIG. 5 illustrates a schematic diagram of a system 300 for controlling operation of the fleet of pumps 302*a* thru 302*j* forming the directly Driven Turbine (DDT) pumping system 400 of the present disclosure. The system 300 controls the one or more hydraulic fracturing pump units 302*a* thru 302*j* that operate to provide the required HHP of the fluid pumping system 400. Only two pump units 302*a*, 302*b* are illustrated in detail in FIG. 3, but it is understood that all of the pump units will be controlled by the control system 300 to operate in a similar manner.

As shown in FIG. 5, the system 300 may also include one or more controllers, such as the controller or control system 330, which may control operations of the DDT pumping system and/or the components of the DDT pumping system. In an embodiment, the controller 330 may interface with one or more Remote Terminal Units (RTU) 340. The RTU 340 may include communication and processing interfaces as well as collect sensor data from equipment attached to the RTU 340 and transmit them to the control system 330. In an embodiment, the control system 330 may act as supervisory control for several RTUs 340, each connected to an individual pump unit 302*a* thru 302*i*. The control system 330 and/or the RTU 340 may include one or more industrial control system (ICS), such as, for example, Supervisory Control and Data Acquisition (SCADA) systems, distributed control systems (DCS), and programmable logic controllers (PLCs), or other suitable control systems and/or control features without departing from the disclosure.

The controller 330 may be communicatively coupled to send signals and receive operational data from the hydraulic fracturing pump units 302*a* thru 302*j* via a communication interface 320, which may be any of one or more communication networks such as, for example, an Ethernet interface, a universal serial bus (USB) interface, or a wireless interface, or any other suitable interface. In certain embodiments, the controller 330 may be coupled to the pump units 302*a* thru 302*j* by way of a hard wire or cable, such as, for example, an interface cable. The controller 330 may include a computer system having one or more processors that may execute computer-executable instructions to receive and analyze data from various data sources, such as the pump units 302*a* thru 302*j*, and may include the RTU 340. The controller 330 may further provide inputs, gather transfer function outputs, and transmit instructions from any number of operators and/or personnel. The controller 330 may perform control actions as well as provide inputs to the RTU 340. In other embodiments, the controller 330 may determine control actions to be performed based on data received from one or more data sources, for example, from the pump units 302*a* thru 302*j*. In other instances, the controller 330 may be an independent entity communicatively coupled to the RTU 340.

Figure 6:
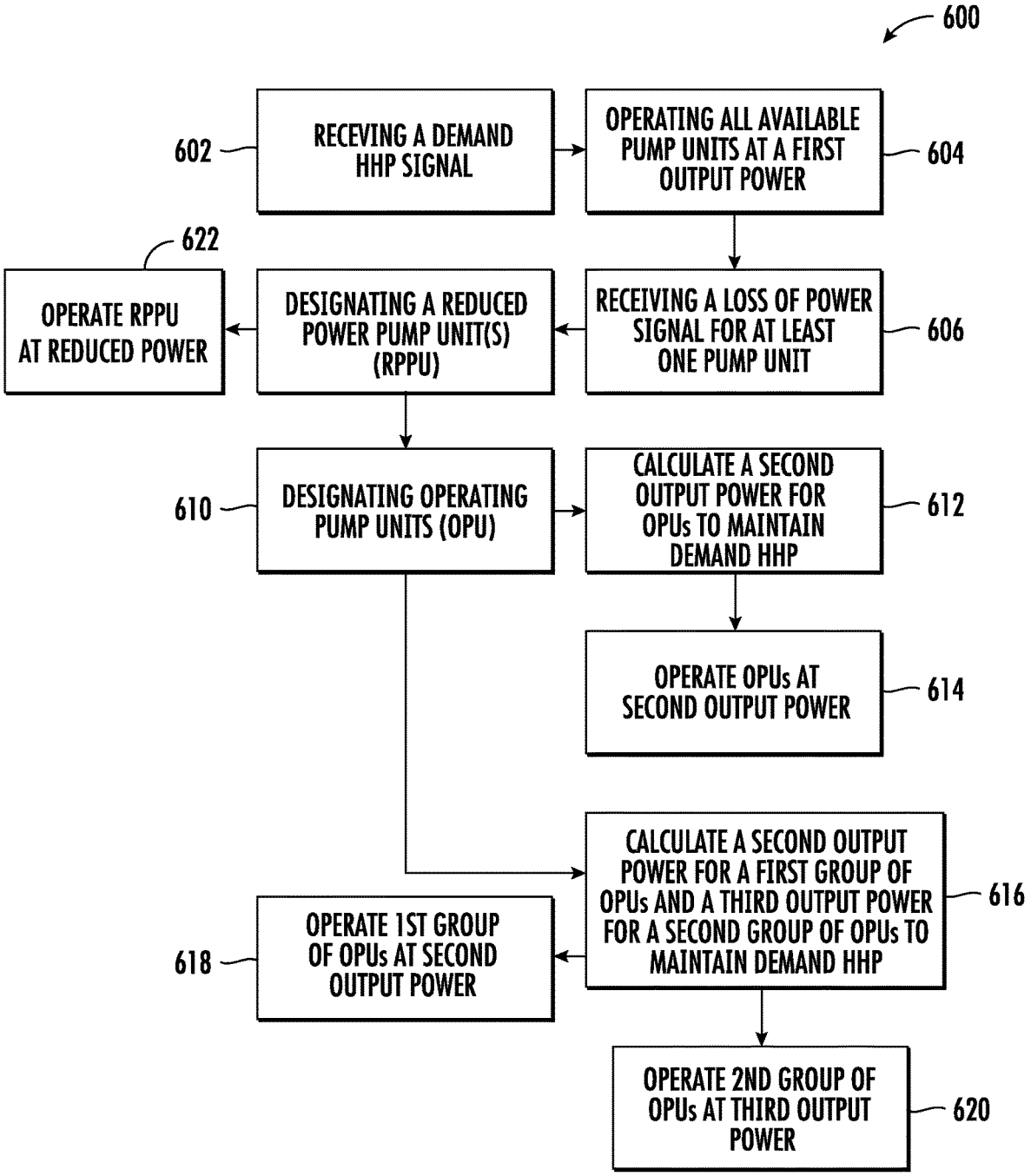
FIG. 6 is a flowchart of a method for operating a fleet of pumps in a DDT fluid pumping system according to an embodiment of the disclosure.

FIG. 6 shows one exemplary embodiment of a flow diagram of a method 600 of operating the plurality of pumps 302*a* thru 302*j* that may be executed by the controller 330. The controller 330 includes a memory that contains computer-executable instructions capable of receiving signals from the sensors associated with the pump units 302*a* thru 302*j*. As shown in FIG. 6, a demand Hydraulic Horse Power (HHP) signal from a master controller or from a controller associated with the fracturing process is received by the controller 330 (Step 602). By way of an example, the demand HHP signal may be a signal corresponding to the demanded power for pumping stimulation fluid associated with the fracturing process. When the demand HHP signal is received, the controller 330 directs operation of all available pump units 302*a* thru 302*j* at a first output power (Step 604). The first output power may be at a percentage rating at or below the MCP level of the pump units 302*a* thru 302*j*. In one example, the first output power may be in the range of approximately 70% to 100% of MCP. By way of an example, the controller 330 may command all the available pump units 302*a* thru 302*j* to operate at 100% of rated MCP based on the demand HHP Signal. In other instances, the controller 330 may command the available pump units 302*a* thru 302*j* to operate at a rated MCP of 70%, 80%, or 95%, based on the requested HHP demand. Alternatively, the controller 330 may command the available pump units 302*a* thru 302*j* to operate at a rated MCP below 70%, or any other rated MCP below 100% without departing from the disclosure.

During operation of the fluid pumping system 300, the controller 330 will monitor the operation of the pumping units 302*a* thru 302*j* including the power utilization and overall maintenance health of each pumping unit. The controller 330 may receive a signal for loss of power from one or more pumping units 302*a* thru 302*j* (Step 606). The loss of power signal may occur if one or more of the pump units 302*a* thru 302*j* loses power such that the detected output power of a respective pump is below the first output power. Further, the loss of power signal may occur if a respective pump unit 302*a* thru 302*j* is completely shut down and experiences a loss of power for any reason (e.g., loss of fuel to turbine 25). Further, one or more of the pump units 302*a* thru 302*j* may be voluntary taken out of service for routine service/maintenance issues including routine maintenance inspection or for other reasons. Upon receiving the loss of power signal, the controller 330 may designate one or more of the pump units 302*a* thru 302*j* as a Reduced Power Pump Unit (RPPU) (Step 608) and designate the remaining pump units as Operating Pump Units (OPUs) (Step 610). In one embodiment, the controller 330 will calculate a second output power at which the OPUs must operate to maintain the needed HHP of the fluid pumping system 400 based on the reduced operating power of the RPPU(s) (Step 612). In one embodiment, the second output power is greater than the first output power and may be in the range of approximately 70% of the MCP level to approximately the MIP level for the pumping units. The controller 330 will revise the operating parameters of the OPUs to operate at the calculated second output power to maintain the HHP of the fluid pumping system 400 (Step 614). The controller 330 continues to monitor the operation of the OPUs to maintain sufficient output of the fluid pumping units 302*a* thru 302*j* to meet the demand HHP for the system 400.

In an alternative embodiment of the method of operation, it may be desired to operate some of the OPUs at different operating powers. In this instance, after designating the OPUs at step 610, the controller 330 will calculate a second output power for a first group of OPUs and calculate a third output power for a second group of OPUs (step 616). In one embodiment, both the second output power and the third output power is greater than the first output power, but one or both of the second output power and the third output power may be equal to or below the first output power without departing from the disclosure. Both the second output power and the third output power may be in the range of approximately 70% of the MCP level to approximately the MIP level for the pumping units. The controller 330 operates the first group of OPUs at the second output power (step 618) and operates the second group of OPUs at the third output power (620) to maintain the sufficient output of the fluid pumping units 302*a* thru 302*j* to meet the demand HHP for the fluid pumping system 400.

The controller 330 will monitor the time that any of the pump units 302*a* thru 302*j* are operated at a second output power or third output power that exceeds the MCP level or approaches or exceeds the MIP level. Operators will be notified when operation of the system 400 at these elevated levels of output power exceed parameters that necessitate a shutdown of the system to avoid failure of the pumping units 302*a* thru 302*j*. Care should be taken to remedy the situation that caused the loss of power signal so that all the pumping units 302*a* thru 302*j* may be returned to their normal output power to maintain the desired HHP of the system 400.

In one embodiment, the loss of power signal received by the controller 330 at step 606 may indicate a reduction in the output power of one or more RPPUs and the controller will continue the operation of the detected RPPUs (step 622) at a reduced power level below the first output power. Further, the loss of power signal received by the controller 330 may indicate a complete loss of power of one or more of the RPPUs 302*a* thru 302*j*. If a complete loss of power of one or more of the pumping units 302*a* thru 302*j* is detected, the second output power and/or third output power would be higher to accommodate for the total loss of power of one or more of the pumping units. In one embodiment, the controller 330 calculates the second output power and/or third output power for the OPUs 302*a*-302*j* in the form of a flow adjustment needed for the OPUs. The second output power and/or third output power of the OPUs 302*a*-302*j* may require operation of the OPUs at or above MIP level for a short period of time (e.g., 30 minutes) while the issues that triggered the loss of power signal (step 606) is corrected.

In one embodiment, during the loss of one or more pump units 302*a*-302*j*, the controller 330 may be able to meet the demand HHP by operating all of the OPUs at a second output power of 100% MCP level. In other embodiments, the controller 330 would be able to meet the demand HHP only by operating all of the OPUs 302*a*-302*j* at a second output power at the MIP level (e.g., 107% of MCP level). In other embodiments, the controller 330 would be able to meet the demand HHP by operating the first group of OPUs 302*a*-302*j* at a second output power at the MIP level and operating the second group of OPUs at a third output power at the MCP level.

By way of an example, for the ten pump unit system 400 shown in FIG. 2, the controller 330 may be able to maintain the demand HHP when one of the ten pump units 302*a*-302*j* is offline (designated the RPPU) by operating two of the OPUs at the MIP level and seven of the OPUs at the MCP level. In another example, the controller 330 may be able to operate three of the OPUs 302*a*-302*j* at the MIP level and six of the OPUs at the MCP level. In another example, the controller may be able to operate one of the OPUs 302*a*-302*j* at the MIP level and eight of the OPUs at the MCP level. In another example, the controller may be able to operate four of the OPUs 302*a*-302*j* at the MIP level and five of the OPUs at the MCP level. The controller 330 may operate various other quantities of OPUs 302*a*-302*j* operating at a second output power and/or third output power without departing from the disclosure.

Figure 7:
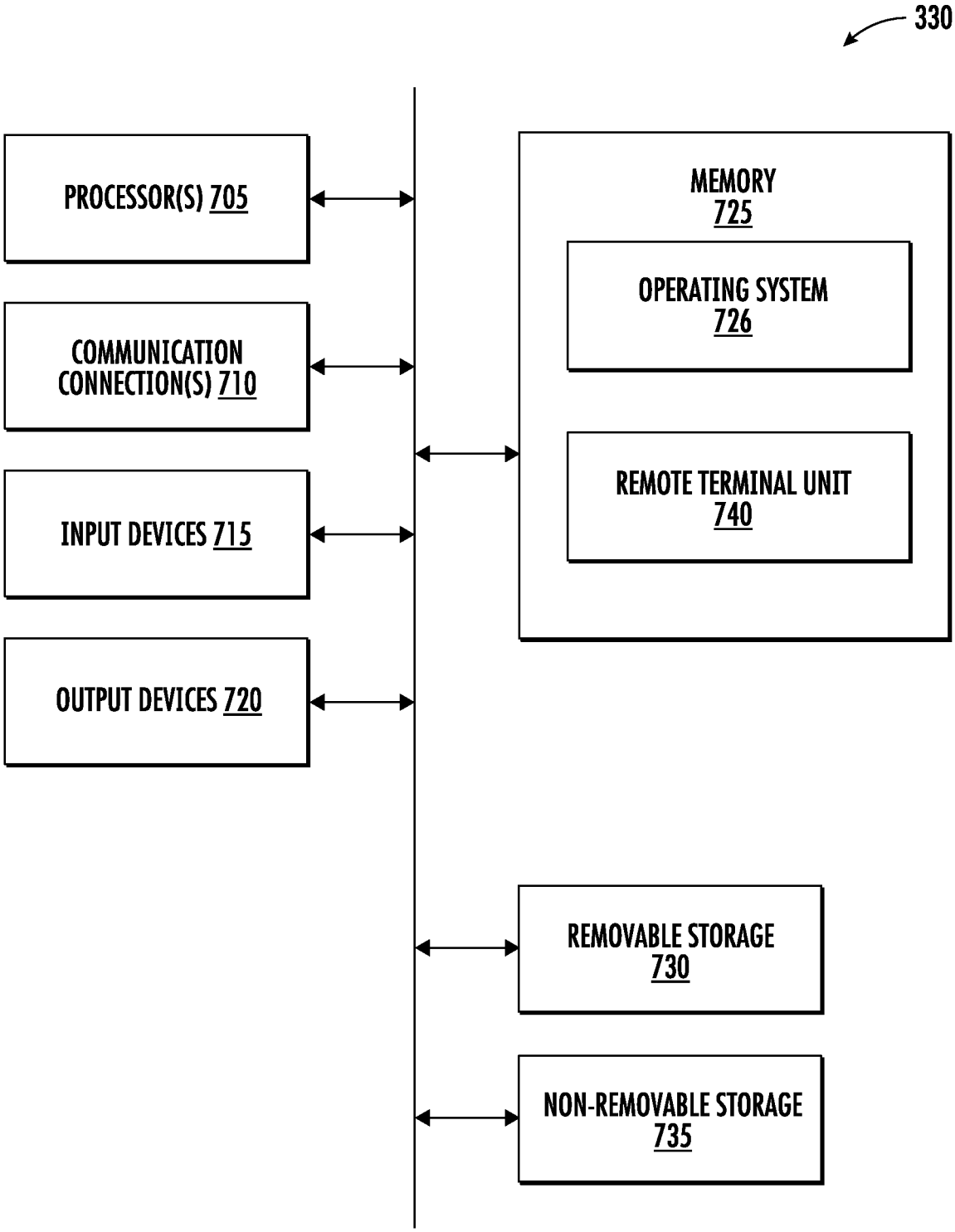
FIG. 7 is a schematic diagram of a controller configured to control operation of the DDT fluid pumping system according to an embodiment of the disclosure.

FIG. 7 illustrates the controller 330 configured for implementing certain systems and methods for operating a fleet of pumps in accordance with certain embodiments of the disclosure. The controller 330 may include a processor 705 to execute certain operational aspects associated with implementing certain systems and methods for operating a fleet of pumps in accordance with certain embodiments of the disclosure. The processor 705 may communicate with a memory 725. The processor 705 may be implemented and operated using appropriate hardware, software, firmware, or combinations thereof. Software or firmware implementations may include computer-executable or machine-executable instructions written in any suitable programming language to perform the various functions described. In one embodiment, instructions associated with a function block language may be stored in the memory 725 and executed by the processor 705.

The memory 725 may be used to store program instructions, such as instructions for the execution of the method 600 described above or other suitable variations. The instructions are loadable and executable by the processor 705 as well as to store data generated during the execution of these programs. Depending on the configuration and type of the controller 330, the memory 725 may be volatile (such as random access memory (RAM)) and/or non-volatile (such as read-only memory (ROM), flash memory, etc.). In some embodiments, the memory devices may include additional removable storage 730 and/or non-removable storage 735 including, but not limited to, magnetic storage, optical disks, and/or tape storage. The disk drives and their associated computer-readable media may provide non-volatile storage of computer-readable instructions, data structures, program modules, and other data for the devices. In some implementations, the memory 725 includes multiple different types of memory, such as static random access memory (SRAM), dynamic random access memory (DRAM), or ROM.

The memory 725, the removable storage 730, and the non-removable storage 735 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

Controller 330 may also include one or more communication connections 710 that may allow a control device (not shown) to communicate with devices or equipment capable of communicating with the controller 330. The controller 330 may also include a computer system (not shown). Connections may also be established via various data communication channels or ports, such as USB or COM ports to receive cables connecting the controller 330 to various other devices on a network. In one embodiment, the controller 330 may include Ethernet drivers that enable the controller 130 to communicate with other devices on the network. According to various embodiments, communication connections 710 may be established via a wired and/or wireless connection on the network.

The controller 330 may also include one or more input devices 715, such as a keyboard, mouse, pen, voice input device, gesture input device, and/or touch input device, or any other suitable input device. It may further include one or more output devices 720, such as a display, printer, and/or speakers, or any other suitable output device. In other embodiments, however, computer-readable communication media may include computer-readable instructions, program modules, or other data transmitted within a data signal, such as a carrier wave, or other transmission.

In one embodiment, the memory 725 may include, but is not limited to, an operating system (OS) 726 and one or more application programs or services for implementing the features and aspects disclosed herein. Such applications or services may include a Remote Terminal Unit 340, 740 for executing certain systems and methods for operating a fleet of pumps in a hydraulic fracturing application. The Remote Terminal Unit 340, 740 may reside in the memory 725 or may be independent of the controller 330, as represented in FIG. 3. In one embodiment, Remote Terminal Unit 340, 740 may be implemented by software that may be provided in configurable control block language and may be stored in non-volatile memory. When executed by the processor 705, the Remote Terminal Unit 340, 740 may implement the various functionalities and features associated with the controller 330 described in this disclosure.

As desired, embodiments of the disclosure may include a controller 330 with more or fewer components than are illustrated in FIG. 7. Additionally, certain components of the controller 330 of FIG. 7 may be combined in various embodiments of the disclosure. The controller 330 of FIG. 7 is provided by way of example only.

In some embodiments, the sizing of downstream equipment (e.g., pump unit discharge piping, manifold, etc.) should be increased compared to that sizing of the standard power output downstream equipment of the pump units to take advantage at operating at the elevated output power of the pump unit during short term use. The pump unit power rating should be increased to allow for the maximum intermittent power of the engine. Further, the size and torque rating of the driveshaft and if applicable torsional vibration dampeners and flywheels also be considered when designing the power train.

Examples of such configurations in a dual shaft, dual fuel turbine engine with a rated shaft horse power of 5100 at standard ISO conditions is used in conjunction with a reduction Helical Gearbox that has a constant running power rating of 5500 SHP & an intermittent power output of 5850 SHP. The engine, gearbox assembly, and the drive shaft should be sized and selected to be able to meet the power and torque requirements at not only the constant running rating of the pump units but also the intermittent/increased loads. In one example, a 390.80 GWB driveshaft may be selected. The drive train may include torsional vibration dampeners as well as single mass fly wheels and their installation in the drive train is dependent on the results from careful torsional vibration analysis. The pump unit may be rated to an elevated horsepower above that of the engine. Common pumps on the market are rated at 7000 HP with the next lowest pump being rated to 5000 HP respectively. The sizing, selection, and assembly of such a drive train would allow reliable operation of the turbine engine above the 100% rated HP value with the resulting hydraulic horse power (HHP) produced being dependent on environmental and other conditions.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that may direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They also may be practiced with other computer system configurations, including hand-held devices, multiprocessor systems, microprocessor based or programmable consumer electronics, mini-computers, mainframe computers, and the like.

Application programs that are components of the systems and methods described herein may include routines, programs, components, data structures, and so forth that implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks may be performed by remote processing devices linked through a communications network.

This application is a continuation of U.S. Non-Provisional application Ser. No. 17/387,477, filed Jul. 28, 2021, titled "METHODS AND SYSTEMS FOR OPERATING A FLEET OF PUMPS," which is a continuation of U.S. Non-Provisional application Ser. No. 17/118,790, filed Dec. 11, 2020, titled "METHODS AND SYSTEMS FOR OPERATING A FLEET OF PUMPS," which is a continuation of U.S. Non-Provisional application Ser. No. 17/022,972, filed Sep. 16, 2020, titled "METHODS AND SYSTEMS FOR OPERATING A FLEET OF PUMPS," now U.S. Pat. No. 10,907,459, issued Feb. 2, 2021, which is continuation of U.S. Non-Provisional application Ser. No. 16/946,082, filed Jun. 5, 2020, titled "METHODS AND SYSTEMS FOR OPERATING A FLEET OF PUMPS," now U.S. Pat. No. 10,815,764, issued Oct. 27, 2020, which claims the benefit of and priority to U.S. Provisional Application No. 62/899,951, filed Sep. 13, 2019, titled "METHODS AND SYSTEMS FOR OPERATING A FLEET OF PUMPS," the entire disclosures of which are incorporated herein by reference.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A method of operating a plurality of pump units associated with a high-pressure, high-power hydraulic fracturing assembly, one or more of the plurality of pump units including a turbine engine connected to a pump, the method comprising:

receiving a demand hydraulic horse power (HHP) signal for operation of the hydraulic fracturing assembly;

based at least in part on the demand HHP signal, operating all available pump units of the plurality of pump units at a first output power to achieve the demand HHP;

receiving a loss of power signal for one or more pump units of the plurality of pump units;

after receiving the loss of power signal, designating one or more pump unit as a reduced power pump unit (RPPU) and the remaining pump units as operating pump units (OPU), the one or more pump units of the OPUs includes at least two pump units;

operating the RPPU at a reduced output power below the first output power;

operating one or more of the OPUs at a second output power by over-firing one or more turbine engines of the one or more OPUs to meet the demand HHP signal for operation of the hydraulic fracturing assembly, the first output power being in a selected range of a maximum continuous power (MCP) level of the plurality of pump units, the second output power being greater than the first output power and being in a selected range of the MCP level to a selected maximum intermittent power (MIP) level of the plurality of pump units; and operating one or more of the OPUs at a third output power, the third output power being in a selected range to approximately the MIP level.

2. The method of claim 1, wherein the third output power comprises an amount of power greater than the first output power.

3. The method of claim 1, wherein the third output power comprises an amount of power approximately equal to the first output power.

4. The method of claim 1, wherein the OPUs operating at the second output power comprise one or more less pump units than the plurality of pump units, wherein a selected range of a maximum continuous power (MCP) level of the plurality of pump units comprises a range of approximately 70% to 100%, wherein the first output power being in the range of approximately 70% of MCP level to approximately a maximum intermittent power (MIP) level of the plurality of pump units, and wherein the selected range of the third output power being approximately 70% to approximately the MIP level.

5. The method of claim 1, wherein the one or more pump units of the OPUs comprises all of the OPUs, and wherein the second output power comprises the MIP level.

6. The method of claim 5, wherein the first output power comprises 100% of the MCP level.

7. The method of claim 5, wherein the first output power comprises 90% of the MCP level.

8. The method of claim 7, wherein the second output power exceeds 100% of the MCP level.

9. The method of claim 8, wherein the second output power comprises the MIP level.

10. The method of claim 1, wherein the second output power comprises the MIP level.

11. The method of claim 1, further comprising after receiving a loss of power signal, shutting down the RPPU.

12. The method of claim 11, wherein the reduced output power of the RPPU comprises an amount of power approximately 20% less than the first output power.

13. The method of claim 1, further comprising shutting down the RPPU, and wherein the second output power comprises an amount of power approximate the MIP level.

14. A system to control operation of a plurality of pump units associated with a hydraulic fracturing assembly, one or more of the plurality of pump units including a turbine engine connected to a pump, the system comprising:

a controller in communication with the plurality of pump units, the controller including one or more processors and memory having computer-readable instructions stored therein and operable by the one or more processors to:

receive a demand hydraulic horse power (HHP) signal for the hydraulic fracturing assembly, based at least in part on the demand HHP signal, operate all available pump units of the plurality of pump units at a first output power to achieve the demand HHP;

receive a loss of power signal from one or more pump units of the plurality of pump units, after receiving the loss of power signal, designate one pump unit as a reduced power pump unit (RPPU) and the computer readable instructions being operable to operate the RPPU at a reduced output power below the first output power, designate the remaining pump units as operating pump units (OPU), the one or more pump units of the OPUs includes at least two pump units, operate one or more of the OPUs at a second output power by over-firing one or more turbine engines of the one or more OPUs to meet the demand HHP signal of the hydraulic fracturing assembly, the first output power being in a selected range of a maximum continuous power (MCP) level of the plurality of pump units, the second output power being greater than the first output power and being in a selected range of MCP level to a maximum intermittent power (MIP) level of the plurality of pump units, and after receiving the loss of power signal, operate one or more of the OPUs at a third output power, the third output power being in a selected range to the MIP level.

15. The system of claim 14, wherein the third output power comprises an amount of power approximately equal to or greater than the first output power.

16. The system of claim 15, wherein the OPUs operating at the second output power comprise one or more less pump units than the plurality of pump units, wherein a selected range of a maximum continuous power (MCP) level of the plurality of pump units comprises a range of approximately 70% to 100%, wherein the first output power being in the range of approximately 70% of MCP level to approximately a maximum intermittent power (MIP) level of the plurality of pump units, and wherein the selected range of the third output power being approximately 70% to approximately the MIP level.

17. The system of claim 14, wherein the one or more pump units of the OPUs comprises all of the OPUs, and wherein the second output power comprises the MIP level.

18. The system of claim 14, wherein the first output power comprises 100% of the MCP.

19. The system of claim 18, wherein the second output power comprises 107% of the MCP level.

20. The system of claim 19, wherein the second output power comprises the MIP level.

21. The system of claim 14, wherein the first output power comprises 90% of the MCP level.

22. The system of claim 14, wherein the second output power comprises the MIP level.

23. The system of claim 14, wherein the reduced output power of the RPPU comprises an amount of power approximately 20% less than the first output power.

24. The system of claim 14, wherein after receiving the loss of power signal, the computer readable instructions are operable to shut down the one or more RPPU, and the second output power comprises an amount of power approximate the MIP level.

25. A system to control operation of a plurality of pump units associated with a hydraulic fracturing assembly, the system comprising:

a turbine engine associated with one or more of the plurality of pump units of the hydraulic fracturing assembly;

a driveshaft associated with the one or more pump units of the hydraulic fracturing assembly;

a gearbox associated with the one or more pump units of the hydraulic fracturing assembly, and connected to the turbine engine and driveshaft, for driving the driveshaft; and a controller in communication with the plurality of pump units, the controller including one or more processors and memory having computer-readable instructions stored therein and operable by the processor to:

receive a demand hydraulic horse power (HHP) signal for the hydraulic fracturing assembly, based at least in part on the demand HHP signal, operate all available pump units of the plurality of pump units at a first output power to achieve the demand HHP;

receive a loss of power signal from one or more pump units of the plurality of pump units, after receiving the loss of power signal, designate one pump unit as a reduced power pump unit (RPPU) and the computer readable instructions being operable to operate the RPPU at a reduced output power below the first output power, designate the remaining pump units as operating pump units (OPU), the one or more pump units of the OPUs includes at least two pump units, and operate one or more of the OPUs at a second output power by over-firing one or more turbine engines of the one or more OPUs to meet the demand HHP signal of the hydraulic fracturing assembly, the first output power being in a selected range of a maximum continuous power (MCP) level of the plurality of pump units, the second output power being greater than the first output power and being in a selected range of MCP level to a maximum intermittent power (MIP) level of the plurality of pump units.

26. The system of claim 25, wherein the OPUs operating at the second output power comprise one or more less pump units than the plurality of pump units, wherein a selected range of a maximum continuous power (MCP) level of the plurality of pump units comprises a range of approximately 70% to 100%, and wherein the first output power being in the range of approximately 70% of MCP level to approximately a maximum intermittent power (MIP) level of the plurality of pump units.

27. The system of claim 25, wherein after receiving the loss of power signal, the computer readable instructions are operable to shut down the RPPU, and the second output power comprises an amount of power approximate the MIP level.

* * * * *